US009745736B2

(12) United States Patent
Wadley et al.

(10) Patent No.: US 9,745,736 B2
(45) Date of Patent: Aug. 29, 2017

(54) THREE-DIMENSIONAL SPACE FRAMES ASSEMBLED FROM COMPONENT PIECES AND METHODS FOR MAKING THE SAME

(71) Applicant: University of Virginia Patent Foundation, Charlottesville, VA (US)

(72) Inventors: Haydn N. G. Wadley, Keswick, VA (US); Liang Dong, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 0 days.

(21) Appl. No.: 14/915,154

(22) PCT Filed: Aug. 27, 2014

(86) PCT No.: PCT/US2014/052936

§ 371 (c)(1),
(2) Date: Feb. 26, 2016

(87) PCT Pub. No.: WO2015/073098

PCT Pub. Date: May 21, 2015

(65) Prior Publication Data

US 2016/0208476 A1 Jul. 21, 2016

Related U.S. Application Data

(60) Provisional application No. 61/870,734, filed on Aug. 27, 2013, provisional application No. 62/003,771,
(Continued)

(51) Int. Cl.
*E04B 1/19* (2006.01)
*C23C 8/22* (2006.01)
(Continued)

(52) U.S. Cl.
CPC ..... *E04B 1/19* (2013.01); *C23C 8/22* (2013.01); *C23C 8/26* (2013.01); *C23C 8/32* (2013.01);
(Continued)

(58) Field of Classification Search
CPC .... E04B 1/19; E04B 2001/1924; Y10S 52/10; Y10T 29/49625
(Continued)

(56) References Cited

U.S. PATENT DOCUMENTS 2,682,235 A 6/1954 Fuller
3,477,189 A * 11/1969 Merson ..... E04B 1/19 29/469
(Continued)

FOREIGN PATENT DOCUMENTS

GB 2490767 A 11/2012
WO WO 98/01596 A1 1/1998
(Continued)

*Primary Examiner* — Andrew J Triggs
(74) *Attorney, Agent, or Firm* — Robert J. Decker

(57) ABSTRACT

A method for producing three-dimensional space frames or truss structures from simpler components and space frames or truss structures produced by the associated method. The various components, which may be made from virtually any material, are shaped in such a way so that they may be fitted together to create a space frame or truss structure. The components may be held together by any available attachment means, or by the interaction of the components themselves. The method and associated components allows for the assembly of three-dimensional space frames or truss structures from planar materials, significantly reducing cost and manufacturing time. These space frames or trusses can then be used as structural members, as the interior load-bearing portions of sandwich panels, or in any situation where high-strength and light weight are desirable.

164 Claims, 14 Drawing Sheets

Related U.S. Application Data filed on May 28, 2014, provisional application No. 62/038,441, filed on Aug. 18, 2014.

(51) Int. Cl.
*C23C 8/26* (2006.01)
*C23C 8/32* (2006.01)

(52) U.S. Cl.
CPC ..... *E04B 2001/1924* (2013.01); *E04B 2001/1966* (2013.01); *E04B 2001/1972* (2013.01); *Y10S 52/10* (2013.01); *Y10T 29/49625* (2015.01)

(58) Field of Classification Search
USPC .... 52/655.1, 81.3, 653.2, 653.1, 648.1, 646, 52/81.1, 655.2, 652.1, 81.2, 633
See application file for complete search history.

(56) References Cited

U.S. PATENT DOCUMENTS 3,882,653 A * 5/1975 Ollman ..... E04B 1/19 29/897.31
4,729,197 A 3/1988 Miller
5,070,673 A 12/1991 Weisse
5,534,314 A 7/1996 Wadley
5,736,073 A 4/1998 Wadley
5,958,551 A * 9/1999 Garcia-Ochoa ..... B32B 3/10 428/137
6,076,324 A 6/2000 Daily
6,170,560 B1 1/2001 Daily
6,478,931 B1 11/2002 Wadley
7,014,889 B2 3/2006 Groves
7,211,348 B2 5/2007 Wadley
7,288,326 B2 10/2007 Elzey
7,401,643 B2 7/2008 Queheillalt
7,424,967 B2 9/2008 Ervin
7,669,799 B2 3/2010 Elzey
7,718,222 B2 5/2010 Hass
7,726,501 B2 * 6/2010 Macqueen ..... B65D 19/20 206/600
7,857,552 B2 * 12/2010 Li ..... E01F 8/023 405/284
7,879,411 B2 2/2011 Hass
7,913,611 B2 3/2011 Terry
7,963,085 B2 6/2011 Sypeck
8,084,086 B2 12/2011 Hass
8,110,043 B2 2/2012 Hass
8,124,178 B2 2/2012 Hass
8,176,635 B2 5/2012 Queheillalt
8,247,333 B2 8/2012 Sypeck
8,360,361 B2 1/2013 Wadley
8,465,825 B1 6/2013 Cumberland
8,474,764 B2 7/2013 Kieselstein
8,579,018 B1 11/2013 Roper
8,635,831 B2 * 1/2014 Rivers ..... E04B 1/19 52/479
8,650,756 B2 2/2014 Wadley
8,745,958 B2 6/2014 Kang
8,784,512 B2 7/2014 Wadley
9,127,450 B2 * 9/2015 Rivers ..... E04B 1/19
2002/0081936 A1 * 6/2002 Snelson ..... A63H 33/10 446/111
2003/0049537 A1 3/2003 Wadley
2003/0054133 A1 3/2003 Wadley
2004/0118347 A1 6/2004 Groves
2004/0123980 A1 7/2004 Queheillalt
2004/0134430 A1 7/2004 Hass
2004/0154252 A1 8/2004 Sypeck
2004/0197519 A1 10/2004 Elzey
2005/0000444 A1 1/2005 Hass
2005/0158573 A1 7/2005 Elzey
2005/0202206 A1 9/2005 Wadley
2005/0255242 A1 11/2005 Hass
2005/0255289 A1 11/2005 Wadley
2005/0266163 A1 12/2005 Wortman
2005/0287296 A1 12/2005 Wadley
2006/0032178 A1 2/2006 Jensen
2006/0048640 A1 3/2006 Terry
2006/0062912 A1 3/2006 Wortman
2006/0080835 A1 4/2006 Kooistra
2006/0137282 A1 * 6/2006 Anvick ..... E04C 5/04 52/649.1
2006/0163319 A1 7/2006 Ervin
2007/0269716 A1 11/2007 Wadley
2008/0006353 A1 1/2008 Elzey
2008/0131611 A1 6/2008 Hass
2008/0135212 A1 6/2008 Queheillalt
2008/0220177 A1 9/2008 Hass
2008/0226870 A1 9/2008 Sypeck
2009/0017217 A1 1/2009 Hass
2009/0188411 A1 * 7/2009 Gibson ..... B65D 19/0022 108/51.3
2009/0274865 A1 * 11/2009 Wadley ..... C23C 16/045 428/110
2009/0282773 A1 11/2009 Queheillalt
2009/0286100 A1 11/2009 Wadley
2009/0307999 A1 12/2009 Nii
2010/0050560 A1 3/2010 Werner
2010/0104819 A1 4/2010 Wadley
2010/0236759 A1 9/2010 Wadley
2010/0242265 A1 9/2010 Wadley
2011/0042512 A1 2/2011 Wadley
2011/0107904 A1 5/2011 Queheillalt
2011/0117315 A1 5/2011 Kang
2011/0250385 A1 10/2011 Sypeck
2011/0283873 A1 11/2011 Wadley
2011/0318498 A1 12/2011 Wadley
2012/0137974 A1 6/2012 Hass
2012/0160166 A1 6/2012 Hass
2012/0285114 A1 11/2012 Queheillalt
2013/0014916 A1 1/2013 Wadley
2013/0067847 A1 * 3/2013 Rivers ..... E04B 1/19 52/648.1
2013/0263727 A1 10/2013 O'Masta
2015/0132535 A1 * 5/2015 Hazenbrink ..... E04B 2/84 428/137
2016/0208476 A1 * 7/2016 Wadley ..... C23C 8/22

FOREIGN PATENT DOCUMENTS

WO WO 99/65626 A1 12/1999
WO WO 01/90438 A1 11/2001
WO WO 01/92001 A1 12/2001
WO WO 02/006747 A1 1/2002
WO WO 02/15300 A1 2/2002
WO WO 02/087787 A1 11/2002
WO WO 02/098644 A2 12/2002
WO WO 03/018853 A2 3/2003
WO WO 03/028428 A2 4/2003
WO WO 03/091473 A1 11/2003
WO WO 03/101721 A1 12/2003
WO WO 03/101722 A1 12/2003
WO WO 2004/011245 A1 2/2004
WO WO 2004/011688 A2 2/2004
WO WO 2004/022868 A2 2/2004
WO WO 2004/022869 A2 3/2004
WO WO 2004/043691 A1 5/2004
WO WO 2004/048632 A2 6/2004
WO WO 2005/014216 A2 2/2005
WO WO 2005/047202 A2 5/2005
WO WO 2005/089107 A2 9/2005
WO WO 2007/005832 A2 1/2007
WO WO 2007/139814 A2 12/2007
WO WO 2008/127301 A1 10/2008
WO WO 2008/131105 A1 10/2008
WO WO 2009/023744 A1 2/2009
WO WO 2009/048676 A1 2/2009
WO WO 2009/061539 A2 5/2009
WO WO 2009/105651 A2 8/2009
WO WO 2010/082970 A2 7/2010
WO WO 2010/099218 A1 9/2010

(56) References Cited

FOREIGN PATENT DOCUMENTS

| | | | |
|---|---|---|---|
| WO | WO 2011/140481 | A1 | 11/2011 |
| WO | WO 2011/142841 | A2 | 11/2011 |
| WO | WO 2012/003026 | A2 | 11/2012 |
| WO | WO 2014/169222 | A2 | 10/2014 |
| WO | WO 2015/073094 | A2 | 5/2015 |

* cited by examiner

THREE-DIMENSIONAL SPACE FRAMES ASSEMBLED FROM COMPONENT PIECES AND METHODS FOR MAKING THE SAME

CROSS REFERENCE TO RELATED APPLICATIONS

The present application is a national stage filing of International Application No. PCT/US2014/052936, filed Aug. 27, 2014, which claims benefit of priority under 35 U.S.C. §119(e) from U.S. Provisional Application Ser. No. 61/870,734, filed Aug. 27, 2013, entitled "Micro-lattice Materials and Structures and Related Methods thereof," U.S. Provisional Application Ser. No. 62/003,771, filed May 28, 2014, entitled "Micro-lattice Materials and Structures and Related Methods thereof;" and U.S. Provisional Application Ser. No. 62/038,441, filed Aug. 18, 2014, entitled "Micro-lattice Materials and Structures and Related Methods thereof;" the disclosures of which are hereby incorporated by reference herein in their entirety.

The present application is related to International Patent Application Serial No. PCT/US2014/052899, Wadley, et al., entitled "Micro-lattice Materials and Structures and Related Methods Thereof," filed Aug. 27, 2014; the disclosure of which is hereby incorporated by reference herein in its entirety.

FIELD OF THE INVENTION

The present invention relates generally to the field of trusses, space frames, and other engineering structures. More specifically, the invention relates to the subfield of three-dimensional space frames.

BACKGROUND

Space frames and trusses are very useful engineering structures in that they can provide high levels of strength while requiring less material than solid beams, columns, or structures. Space frames also allow for scalable construction through the repetition of a unit cell, and may offer very high levels of strength while reducing weight and material use because the material is focused along load paths offering a more efficient structural design. However, space frames can be very complex structures, and as a result may be expensive or difficult to produce, particularly on a small scale.

Overview

An aspect of an embodiment of the present invention provides components that may be used to assemble complex space frames and methods for making and assembling those components into useable structures. By using simple, easy to manufacture components, a space frame may be assembled quickly and cheaply. Furthermore, an aspect of an embodiment of the present invention allows for space frames to be assembled from a wide variety of materials that may not have been conducive to traditional methods of space frame construction. Using the components and methods of the present invention, space frames of nearly any relative size or dimension may be assembled from a wide variety of materials, even those which may require non-traditional means of joining or fabrication.

An aspect of an embodiment of the present invention provides, among other things, components that may be simply and cheaply manufactured that are suited to be assembled into three-dimensional space frames and a method for doing so. By assembling complex engineering structures from simple components that may be attached in a number of ways, space frames of nearly any relative dimension may be constructed at lower cost, with materials that may not traditionally be conducive to the production of these structures. Furthermore, space frames can be mass produced from interchangeable manufactured components that will allow for their use in any number of applications that may not have been possible before. Finally, the use of components to assemble the structures allows for scalability by simply adding or subtracting the number of components or associated layers without having to redesign or alter the components themselves. Similarly, the use of components to assemble the structures allows for scalability by simply increasing or decreasing the size of components or associated layers without having to redesign or alter the components themselves.

An aspect of an embodiment of the present invention provides, among other things, a method for producing a space frame. The method may comprise:

a) providing a plurality of first members comprising alternating linear struts with inflection areas between the alternating linear struts, the first members having an anterior surface and a posterior surface, a recess at each the inflection area of the first members to define an inflection recess, all of the inflection recesses disposed along the anterior surface of the first member;

b) arranging the plurality of the first members into an array with a first portion of the plurality of the first members arrayed substantially parallel to one another; and arranging a second portion of the plurality of the first members arrayed substantially orthogonal to the arrayed first portion of the plurality of the first members, so as to define an intersecting array structure;

wherein the first portion of the plurality of the first members is inverted with respect to the second portion of the plurality of the first members so that the anterior surfaces of the first portion of the plurality of the first members may be in communication with the anterior surfaces of the second portion of the plurality of the first members;

the first portion of the plurality of the first members and the second portion of the plurality of the first members aligned so that the inflection recesses of the inflection areas of the first portion of the plurality of the first members are in communication with the inflection recesses of the inflection areas of the second portion of the plurality of the first members to define a tenon or tenon-like structure;

c) providing a lattice shape member comprising struts disposed between nodes, each of the nodes having a mortise recess configured to interface with the tenon or tenon-like structures, the struts configured such that the nodes are located such that the mortise recesses are properly spaced so as to communicate with the tenons or tenon-like structures from the array comprised of the plurality of the first members; and d) disposing the lattice shape member such that the mortise recess of the nodes are in communication with the tenons or tenon-like structures to provide a space frame.

An aspect of an embodiment of the present invention provides, among other things, a space frame device assembled from components. The space frame device may comprise:

a) a plurality of first members comprising alternating linear struts with inflection areas between the alternating linear struts, the first members having an anterior surface and a posterior surface, a recess at each the inflection area of the first members to define an inflection recess, all of the inflection recesses disposed along the anterior surface of the first member;

b) the plurality of the first members in an array with a first portion of the plurality of the first members arrayed substantially parallel to one another, with a second portion of the plurality of the first members arrayed substantially orthogonal to the arrayed first portion of the plurality of the first members, so as to define an intersecting array structure;

the first portion of the plurality of the first members inverted with respect to the second portion of the plurality of the first members so that the anterior surfaces of the first portion of the plurality of the first members are in communication with the anterior surfaces of the second portion of the plurality of the first members;

the first portion of the plurality of the first members and the second portion of the plurality of the first members aligned so that the inflection recesses of the inflection areas of the first portion of the plurality of the first members are in communication with the inflection recesses of the inflection areas of the second portion of the plurality of the first members to define a tenon or tenon-like structure; and c) a lattice shape member comprising struts disposed between nodes, each of the nodes having a mortise recess configured to interface with the tenon or tenon-like structures, the struts configured such that the nodes are aligned such that the mortise recesses are in communication with the tenons or tenon-like structures from the array comprised of the plurality of the first members.

An aspect of an embodiment of the present invention provides, among other things, a method for producing a space frame. The method may comprise:

a) providing a plurality of first members comprising alternating struts with inflection areas between the alternating struts, the first members having an anterior surface and a posterior surface, a recess at each the inflection area of the first members to define an inflection recess, all of the inflection recesses disposed along the anterior surface of the first member;

b) arranging the plurality of the first members into an array with a first portion of the plurality of the first members arrayed substantially parallel to one another; and arranging a second portion of the plurality of the first members arrayed substantially orthogonal to the arrayed first portion of the plurality of the first members, so as to define an intersecting array structure;

wherein the first portion of the plurality of the first members is inverted with respect to the second portion of the plurality of the first members so that the anterior surfaces of the first portion of the plurality of the first members may be in communication with the anterior surfaces of the second portion of the plurality of the first members;

the first portion of the plurality of the first members and the second portion of the plurality of the first members aligned so that the inflection recesses of the inflection areas of the first portion of the plurality of the first members are in communication with the inflection recesses of the inflection areas of the second portion of the plurality of the first members to define a tenon or tenon-like structure;

c) providing an intermediate member comprising mortise recesses configured to interface with the tenon or tenon-like structures, the intermediate member configured such that the mortise recesses are properly spaced so as to communicate with the tenons or tenon-like structures from the array comprised of the plurality of the first members; and d) disposing the intermediate member such that the mortise recess are in communication with the tenons or tenon-like structures to provide a space frame.

An aspect of an embodiment of the present invention provides, among other things, a device having a space frame assembled from components. The space frame may comprise:

a) a plurality of first members comprising alternating struts with inflection areas between the alternating struts, the first members having an anterior surface and a posterior surface, a recess at each the inflection area of the first members to define an inflection recess, all of the inflection recesses disposed along the anterior surface of the first member;

b) the plurality of the first members in an array with a first portion of the plurality of the first members arrayed substantially parallel to one another, with a second portion of the plurality of the first members arrayed substantially orthogonal to the arrayed first portion of the plurality of the first members, so as to define an intersecting array structure;

the first portion of the plurality of the first members inverted with respect to the second portion of the plurality of the first members so that the anterior surfaces of the first portion of the plurality of the first members are in communication with the anterior surfaces of the second portion of the plurality of the first members;

the first portion of the plurality of the first members and the second portion of the plurality of the first members aligned so that the inflection recesses of the inflection areas of the first portion of the plurality of the first members are in communication with the inflection recesses of the inflection areas of the second portion of the plurality of the first members to define a tenon or tenon-like structure; and c) an intermediate member comprising mortise recesses configured to interface with the tenon or tenon-like structures, the intermediate member configured such that the mortise recesses are in communication with the tenons or tenon-like structures from the array comprised of the plurality of the first members.

An aspect of an embodiment of the present invention provides, among other things, a method for producing three-dimensional space frames or truss structures from simpler components and space frames or truss structures produced by the associated method. The various components, which may be made from virtually any material, are shaped in such a way so that they may be fitted together to create a space frame or truss structure. The components may be held together by any available attachment means, or by the interaction of the components themselves. The method and associated components allows for the assembly of three-dimensional space frames or truss structures from planar materials, significantly reducing cost and manufacturing time. These space frames or trusses can then be used as structural members, as the interior load-bearing portions of sandwich panels, or in any situation where high-strength and light weight are desirable.

These and other objects, along with advantages and features of various aspects of embodiments of the invention disclosed herein, will be made more apparent from the description, drawings, and claims that follow.

DESCRIPTION OF THE DRAWINGS

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF EXEMPLARY EMBODIMENTS OF THE INVENTION

Figure 1:
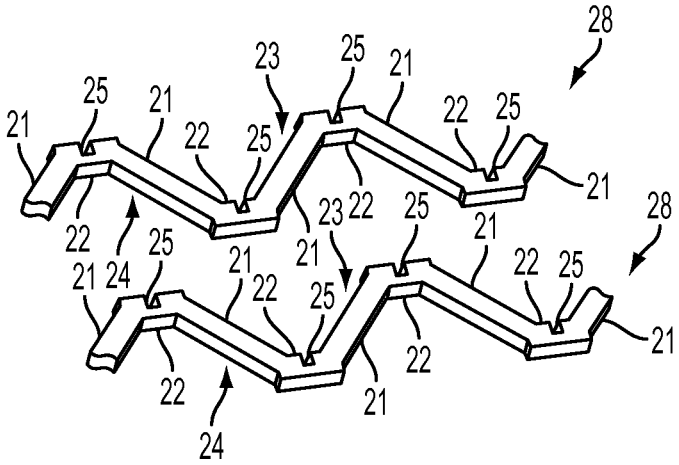
FIG. 1 provides a schematic illustration of an embodiment of first members.

FIG. 1 provides a schematic illustration of an aspect of an embodiment of the first members 28, for example, that may be used to assemble a space frame or truss. In one embodiment, the first members 28 may comprise a variety of structures or sub-structures that define the particular geometry of the first members 28 as desired or required for the particular application. For instance, referring to FIG. 1, the first members 28 are composed of alternating linear struts 21 which are arranged between inflection areas 22. The struts 21 are arranged in communication with the inflection areas 22 so as to create a zig-zag shape to the first member 28. It should be appreciated that the alternating struts 21, while shown as generally straight members in FIG. 1 may take on any number of shapes as desired or required for a particular application. For instance, the alternating struts 21 may be linear, curved, any combination of curved and linear, or segmented. Furthermore, the alternating struts 21 may have a cross-sectional shapes including, but not limited to, square, rectangular, circular, elliptical, or ovoid as necessary to accommodate any particular use, base material, or manufacturing process. It should also be appreciated that the material from which the first member 28 is made may be of constant or varying thickness or cross-section.

Still referring to FIG. 1, in an aspect of an embodiment of the present invention, the first members 28 have an anterior surface 23 and a posterior surface 24. Along the anterior surface 23 and generally located at each inflection area 22 are a number of inflection recesses 25. These inflection recesses 25 may take a number of forms or geometries, including but not limited to, slots, notches, grooves, apertures, or passages. It should be appreciated that the inflection recesses 25 may be configured so as to interface with other inflection recesses 25. Said differently, the slots, notches, grooves, apertures, or passages that comprise the inflection recesses 25 are configured so that each inflection recess 25 of any first member 28 may fit or interface with a corresponding inflection recess 25 of one or any number of other first members 28.

Figure 2:
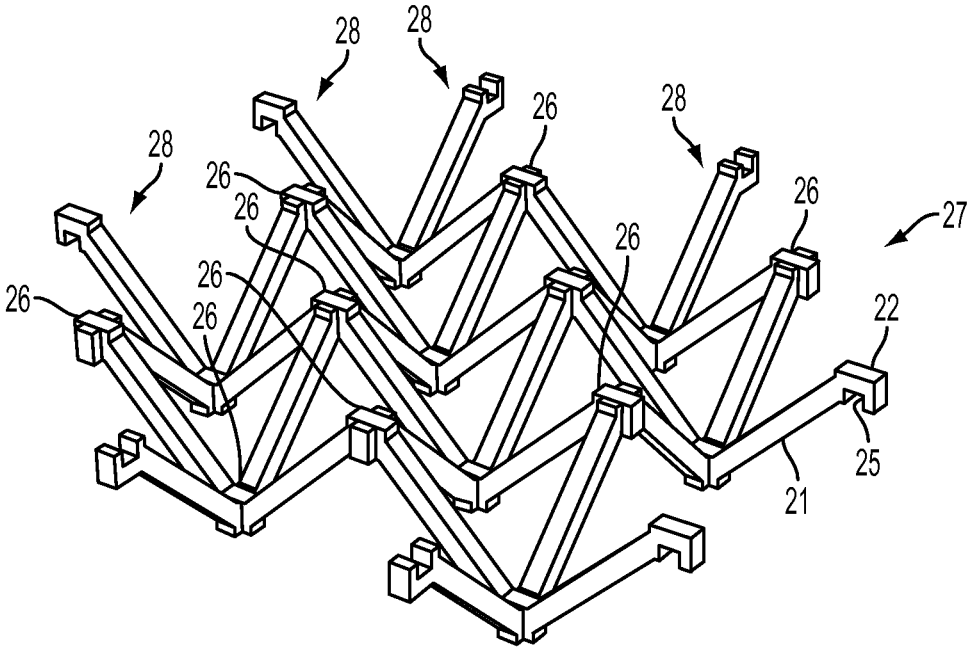
FIG. 2 provides a schematic illustration of an embodiment of an intersecting array structure.

FIG. 2 provides a schematic illustration of an intersecting array structure 27 of an aspect of an embodiment of the present invention. As shown, the interesting array structure 27 is composed of a number of first members 28 which are arranged in such a way as to allow them to interface or fit together to form a structure. In order to form the intersecting array structure 27, a plurality of first members 28 are generally separated into two groups or divisions. One of the groups or divisions of first members 28 are then laid out or arrayed substantially parallel to one another. When laid or arrayed out, all of the first members 28 of this first group or division are arranged so that their anterior surfaces 23 (as discussed with and shown in FIG. 1) are orientated in the same direction. As shown in FIG. 2, in an aspect of an embodiment of the present invention, the alternating struts 21 of the first group or division of first members 28 determine the position of the inflection areas 22. The inflection areas 22 of the first group or division of first members 28 are then arranged so that their anterior surfaces, and consequently the corresponding inflection recesses 25 are orientated in the same direction.

Still referring to FIG. 2, a second group or division of first members 28 is then laid out or arrayed substantially orthogonal to the first group of first members 28. As a result of their orientation being substantially orthogonal to the substantially parallel first group or division of first members 28, the second group or division of first members 28 will be substantially parallel with respect to one another. This second group or division of first members 28 are arranged such that their anterior surfaces are inverted with respect to the anterior surfaces of the first group or division of first members 28. Said differently, the anterior surfaces of the first group or division of first members 28 are opposed to the anterior surfaces of the second group or division of first members 28. As shown in FIG. 2, this arrangement leads to one portion of first members 28 arranged so that their inflection recesses 25 are facing towards the top of FIG. 2 while the second portion of first members 28 are arranged such that their inflection recesses 25 are facing towards the bottom of FIG. 2. This arrangement allows the anterior surfaces of the first group or division of first members 28 to be in communication with the anterior surfaces of the second group or division of first members 28. Consequently, the inflection recesses 25 of the first group or division of first members 28 are in communication with the inflection recesses 25 of the second group or division of first members 28. It should be appreciated that the configuration of the alternating struts 21 of the first members 28 is such that the inflection recesses 25 of the first and second groups or divisions of first members 28 will align with one another when they are arrayed as described above. This alignment can be seen in FIG. 2, and allows for the two groups or divisions of first members 28 to interface with one another to define a number of tenon or tenon-like structures 26. These tenon or tenon-like structures 26 are defined by the shape of the inflection areas 22 and the interaction of the inflection recesses 25. The particular geometry of the tenon or tenon-like structures 26 is determined by the particular geometry and interaction of the inflection areas 22 and inflection recesses 25 and may be adjusted as desired or required for any particular application, material, or need.

Still referring to FIG. 2, it should be appreciated that the interface of the first members 28 to form a tenon or tenon-like structure 26 may define a joint. In particular, this joint may be defined as a halved joint dependent on the particular configuration of the inflection recesses 25 and inflection areas 22. Furthermore, it should be appreciated that this interface or joint may be held together by a number of different methods, interactions, devices, or materials. For example, the interface or joint located at or within the tenon or tenon-like structure 26 may be held together by, but not limited to, brazing, bonding, gluing, diffusion bonding, sintered powder, epoxy, pinning, or wedging. It should also be appreciated that the joint or interface at or within the tenon or tenon-like structure 26 may be held together by the arrangement or configuration of the inflection recesses 25 and or inflection areas 22 themselves. For example, the interface or joint may be secured by means of inflection recesses 25 or inflection areas 22 that snap together, inflection recesses 25 or inflection areas 22 that are configured to form a friction fit, inflection recesses 25 or inflection areas 22 that are configured for to form an interference fit, or any combination thereof. Additionally, it should be appreciated that any combination of brazing, bonding, gluing, diffusion bonding, sintered powder, epoxy, pinning, wedging, snapping, friction fitting, or interference fitting may be used together in order to hold together the joint located at or within the tenon or tenon-like structure 26. In certain applications, the joint located at or within the tenon or tenon-like structure 26 may be held together by the external forces applied to the intersecting array structure 27 or any assembly which the intersecting array structure 27 may be a part of.

Figure 3A:
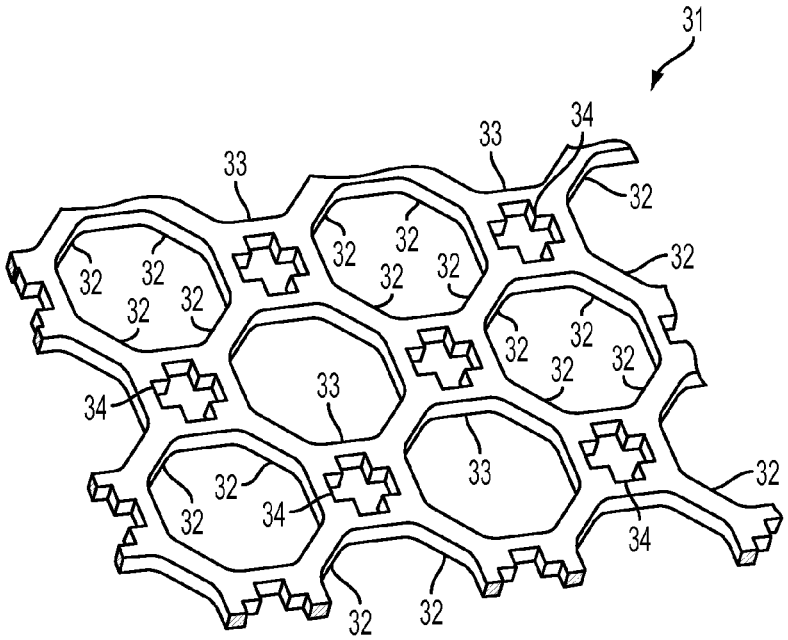
FIGS. 3A and 3B provide schematic illustrations of embodiments of a lattice shape member and intermediate member.

FIG. 3A provides a schematic illustration of a lattice shape member 31 of an aspect of an embodiment of the present invention. The lattice shape member 31 is composed of struts 32 disposed between nodes 33. Each node 33 has a mortise recess 34. The mortise recesses 34 are configured in such a way as to interface or fit with the tenon or tenon-like structures 26 (as shown in FIG. 2). It should be appreciated that the struts 32 of the lattice shape member 31 are configured so as to locate the nodes 32, and their respective mortise recesses 34, so that they will properly align with and interface with the spacing and orientation of the tenon or tenon-like structures 26 of the intersecting array structure 27 (as seen in FIG. 2). It should also be appreciated that the mortise recesses 34 may take on any shape or geometry as desired or required to fit or interface with the shape or geometry of the tenon or tenon-like structures 26 (as seen in FIG. 2). The mortise shaped recess 34 may comprise a slot, notch, groove, aperture, or passage. The mortise recesses 34 may then take on shapes including, but not limited to, circular, rectangular, square, ovoid, regular, or irregular shapes. Furthermore, the mortise recesses 34 may be configured to any depth as desired or required by the specific application. For instance, the mortise recesses 34 may pass entirely through the lattice shape member 31, or they may be configured as recesses that do not pass entirely through the lattice shape member 31. In the case of a mortise recess 34 that does not pass entirely through the lattice shape member 31, it should be appreciated that the mortise recess 34 may constitute any proportion of the thickness of the lattice shape member 31, including proportions both above and below half the thickness of the lattice shape member 31.

Still referring to FIG. 3A, it should be appreciated that the lattice shape member 31 may be configured in any way as to perform the intended function of a particular application. For instance, the lattice shape member 31 may have nodes 33 that are square, rectangular, round, or any regular or irregular shape. Furthermore, the struts 32 may be linear, curved, any combination of curved and linear, or segmented. The particular design and relative size of the struts 32 and nodes 33 will determine the dimensions and shapes of the open areas between the struts 32 and nodes 33, if any. It should also be appreciated that the lattice shape member 31 or any of its sub-components, including struts 32, nodes 33, and mortise recesses 34, may have cross-sectional shapes including, but not limited to, square, rectangular, circular, elliptical, or ovoid as necessary to accommodate any particular use, base material, or manufacturing process. It should also be appreciated that the material from which the lattice shape member 31 is made may be of constant or varying thickness or cross-section.

Figure 3B:
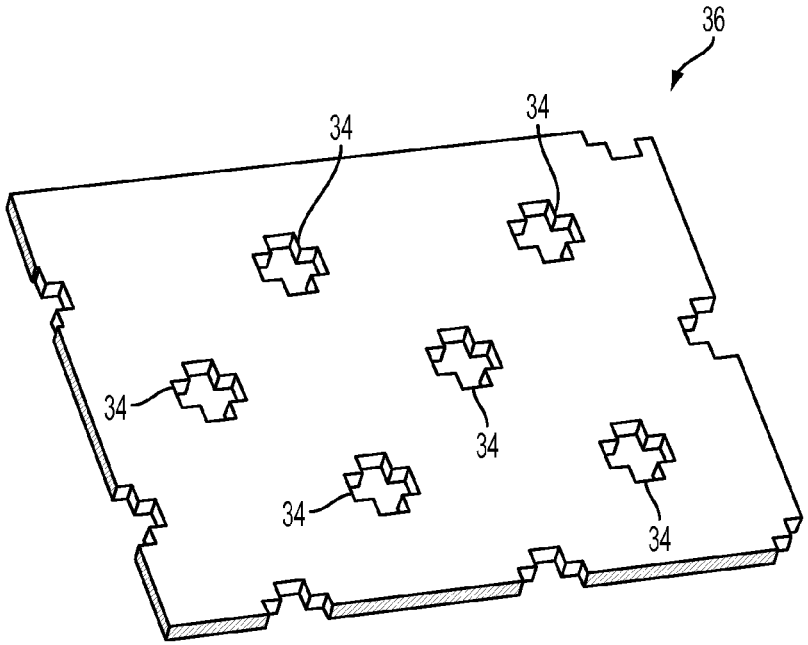

FIG. 3B provides a schematic illustration of an intermediate member 36. The intermediate member 36 is similar in function to the lattice shape member 31 (as shown in FIG. 3A), but it is composed of only a substantially planar material with mortise recesses 34. The function of the intermediate member 36 is substantially similar to the function of the lattice shape member 31 (as shown in FIG. 3A), the primary difference being a different selection of trade-offs between weight and ease of manufacture and cost. As with the lattice shape member 31 (as shown in FIG. 3A), the mortise recesses 34 of the intermediate member 36 are configured in such a way as to interface or fit with the tenon or tenon-like structures 26 (as shown in FIG. 2). The spacing and locations of the mortise recesses 34 on the intermediate member 36 are chosen so that they will properly align with and interface with the spacing and orientation of the tenon or tenon-like structures 26 of the intersecting array structure 27 (as seen in FIG. 2). It should also be appreciated that the mortise recesses 34 may take on any shape or geometry as desired or required to fit or interface with the shape or geometry of the tenon or tenon-like structures 26 (as seen in FIG. 2). The mortise shaped recess 34 may comprise a slot, notch, groove, aperture, or passage. The mortise recesses 34 may then take on shapes including, but not limited to, circular, rectangular, square, ovoid, regular, or irregular shapes. Furthermore, the mortise recesses 34 may be configured to any depth as desired or required by the specific application. For instance, the mortise recesses 34 may pass entirely through the intermediate member 36, or they may be configured as recesses that do not pass entirely through the intermediate member 36. In the case of a mortise recess 34 that does not pass entirely through the intermediate member 36, it should be appreciated that the mortise recess 34 may constitute any proportion of the thickness of the intermediate member 36, including proportions both above and below half the thickness of the intermediate member 36. It should also be appreciated that the material from which the intermediate member 36 is made may be of constant or varying thickness or cross-section.

Figure 4:
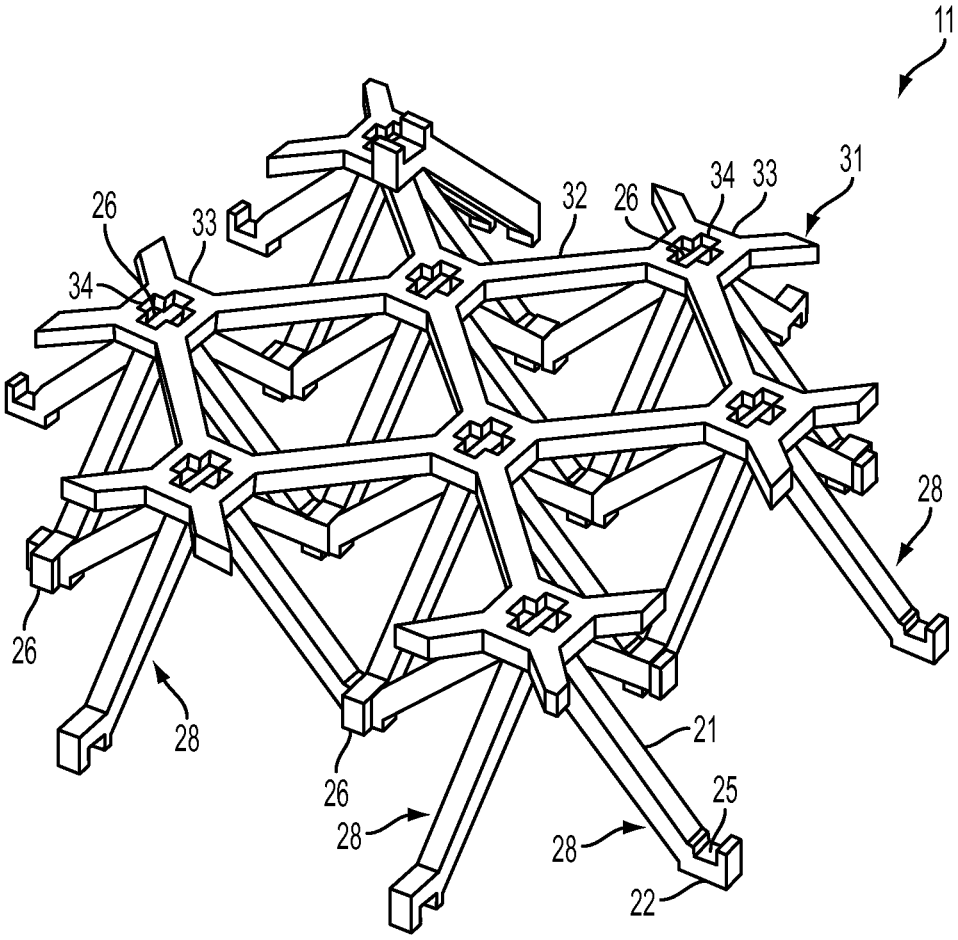
FIG. 4 provides a schematic illustration of an embodiment of a space frame assembled from components.

FIG. 4 provides a schematic illustration of an aspect of an embodiment of a space frame 11 assembled from components. The space frame 11 is assembled from a lattice shape member 31 and a number of first members 28 which have been arranged in such a way as to interface with one another. As can be seen in FIG. 4, the lattice shape member 31 is disposed in such a way that the nodes 33 and their respective mortise recesses 34 are aligned with and in communication with the tenon or tenon-structures 26. The tenon or tenon-like structures 26 are shown fitting into and partially penetrating the mortise recesses 34. It should be appreciated that the tenon or tenon-like structures 26 may partially penetrate the mortise recesses 34, fully and flushly penetrate the mortise recesses 34, or fully penetrate the mortise recesses 34 and extend or protrude from the other side.

Still referring to FIG. 4, it is possible to see how the arrangement and configuration of the struts 32 allows the nodes 33 and the mortise recesses 34 to align correctly with the tenon or tenon-like structures 26 formed by the intersection of first members 28. It should also be appreciated that the configuration of the alternating struts 21, including both their length and angle with respect to the inflection areas 22, allows for the proper orientation and location of the tenon or tenon-like structures 26 to correctly interface with the mortise recesses 34. An exposed inflection recess 25 of a first member 28 is also shown to illustrate how the inflection recesses 25 interact to form the tenon or tenon-like structures 26.

Still referring to FIG. 4, the interface or communication of the lattice shape member 31 and the tenon or tenon-like structure 26 may define a joint. In particular, this joint may be defined as a mortise and tenon joint dependent on the particular configuration of the tenon or tenon-like structures 26 and the lattice shape member 31. The interface or joint between the lattice shape member 31 and the tenon or tenon-like structure 26 may be held together by a number of different methods, interactions, devices, or materials. For example, the interface or joint at or between the lattice shape member 31 and the tenon or tenon-like structure 26 may be held together by, but not limited to, brazing, bonding, gluing, diffusion bonding, sintered powder, epoxy, pinning, or wedging. It should also be appreciated that the joint or interface at or between the tenon or tenon-like structure 26 and the lattice shape member 31 may be held together by the arrangement or configuration of the tenon or tenon-like structures 26 and or lattice shape member 31 and mortise recesses 34 themselves. For example, the interface or joint may be secured by means of tenon or tenon-like structures 26 or mortise recesses 34 that snap together, tenon or tenon-like structures 26 or mortise recesses 34 that are configured to form a friction fit, tenon or tenon-like structures 26 or mortise recesses 34 that are configured for to form an interference fit, or any combination thereof. Additionally, it should be appreciated that any combination of brazing, bonding, gluing, diffusion bonding, sintered powder, epoxy, pinning, wedging, snapping, friction fitting, or interference fitting may be used together in order to hold together the joint located at or between the tenon or tenon-like structure 26 and the lattice member 31. In certain applications, the joint located at or between the tenon or tenon-like structure 26 and the lattice member 31 may be held together by the external forces applied to the space frame 11 or any assembly which the space frame 11 may be a part of. It should also be appreciated that in the preceding discussion, an intermediate member 36 (as shown in FIG. 3B) may substitute for the lattice shape member 31 and its constituent mortise recesses 34.

Still referring to FIG. 4, it should be appreciated that the assembly method described above may vary to fit any number of desired manufacturing processes. For instance, the order of assembly may be varied as desired or required. It is possible that the assembly of a space frame from first members 28 and a lattice shape member 31 may be accomplished by first laying out the lattice shape member 31, and then subsequently arranging the first members 28 onto the lattice shape member 31. This particular mode of assembly may make use of the lattice shape member 31 as a template for arranging the two groupings or divisions of first members 28 which are laid out to form the intersecting array 27 as shown in FIG. 2. Furthermore, at any point in the assembly of the space frame, the lattice shape member 31 may be substituted for by the intermediate member 36 as shown in FIG. 3B.

Still referring to FIG. 4, it should be appreciated that the space frame 11 may be configured for use in any number of applications where its particular properties may be useful. For example, the space frame may be constructed with an additional lattice shape member or intermediate member disposed at the lower point of the drawings (not shown). Furthermore, the space frame 11 may be configured for use in the interior of a sandwich panel, or for use in communication with a plate, substrate, sheet of material, or piece of equipment. The space frame 11 may be used in these applications either with a lattice shape member or intermediate member forming a base or attachment point, or it may be used wherein the first members 28 are directly connected to the substrate, plate, or piece of equipment. Said differently, it should be appreciated that one of the lattice shape members or intermediate members (not shown) may be replaced by a substrate. That substrate may be composed of a plate, sheet of material, or any other component or structure that may interface or integrate with the space frame 11.

Moreover, without intent to limit the applications of the invention in any regard, some example applications demonstrating the use of the space frame or truss structure may include one or more of any combination of the following:

a) an architectural structure (for example: pillars, walls, shielding, foundations or floors for tall buildings or pillars, wall shielding floors, for regular buildings and houses), b) a civil engineering field structure (for example: road facilities such as noise resistant walls and crash barriers, road paving materials, permanent and portable aircraft landing runways, pipes, segment materials for tunnels, segment materials for underwater tunnels, tube structural materials, main beams of bridges, bridge floors, girders, cross beams of bridges, girder walls, piers, bridge substructures, towers, dikes and dams, guide ways, railroads, ocean structures such as breakwaters and wharf protection for harbor facilities, floating piers/oil excavation or production platforms, airport structures such as runways), military security/protection/defense structures, c) a machine structure (for example: frame structures for carrying system, carrying pallets, frame structure for robots, etc.), d) an automobile structure (for example: body, frame, doors, chassis, roof and floor, side beams, bumpers, etc.), e) a ship structure (for example: main frame of the ship, body, deck, partition wall, wall, etc.), f) a freight car structure (for example: body, frame, floor, wall, etc.), g) an aircraft structure (for example: wing, main frame, body, floor, etc.), h) a spacecraft structure (for example: body, frame, floor, wall, etc.), i) a space station structure (for example: the main body, floor, wall, etc.), j) a submarine, ship or water craft structure (for example: body, frame, etc.), and k) a blast, ballistic, projectile, shock or impact resistant structure (or any combination thereof).

It should be appreciated that the space frame 11 or truss structure 35 (or any space frame or truss structure disclosed herein) and their related elements may be treated using any of the techniques, methods, materials, and compositions disclosed in International Patent Application Serial No. PCT/US2014/052899, Wadley, et al., entitled "Lattice Materials and Structures and Related Methods Thereof," filed Aug. 27, 2014.

It should be appreciated that the space frame 11 or truss structure 35 (or any space frame or truss structure disclosed herein) and their related elements may be implemented with any of the structures or related elements disclosed in International Patent Application Serial No. PCT/US2014/052899, Wadley, et al., entitled "Lattice Materials and Structures and Related Methods Thereof," filed Aug. 27, 2014. For example, but not limited thereto, it should be appreciated that the space frame 11 or truss structure 35 (or any space frame or truss structure disclosed herein) may be utilized as part of a sandwich structure or include exterior or interior type of panels.

Figure 5A:
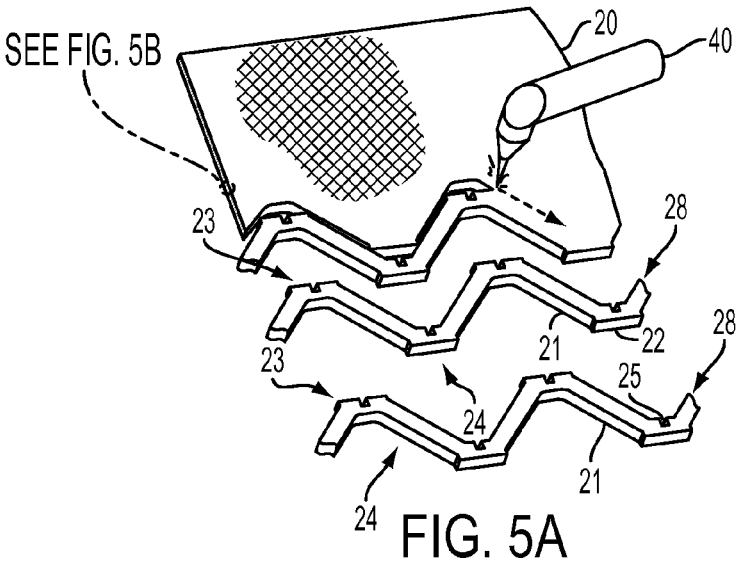
FIGS. 5A and 5B provide schematic illustrations of an embodiment of the process for manufacturing first members.

FIG. 5A provides a schematic illustration of an aspect of an embodiment of the production of first members 28. A cutting tool 40 may be used to cut and shape first members 28 from a substantially planar material 20. As shown in FIG. 5A, the cutting tool 40 may be employed in a single-step process to shape not only the general geometry of the first member 28, but to also cut out or otherwise form the anterior surface 23, posterior surface 24, alternating struts 21, inflection areas 22, and inflection recesses 25. It should also be appreciated that the manufacturing process may involve a multi-step process, wherein the shapes of the first members 28 are initially roughed out as they are separated from the substantially planar material 20. After this initial step, the subsequent details of the first members 28, including alternating struts 21, inflection areas 22, inflection recesses 25, and anterior 23 and posterior surfaces 24 may be shaped or formed in a subsequent step or steps that may or may not involve the machinery or manufacturing process of the initial step.

Still referring to FIG. 5A, it should be appreciated that any number of processes may be applied to the manufacture of first members 28. The process of producing first members 28 may include cutting, as with water jets, lasers, saws, or blades. The process of producing first members 28 may also include machining processes, including but not limited to traditional machining processes such as milling and drilling, electro discharge machining, or any other machining process capable of forming the first members 28. Stamping processes may also be used to produce the first members 28.

It should be appreciated that the first members may be made from any number of other processes, not all of which involve planar or substantially planar materials. For example, first members may be molded, cast, forged, 3D printed, formed through a sintering process, or any other method of manufacturing that is sufficient to produce first members of sufficient strength and with correct dimensional properties. The choice of manufacturing method may depend on such factors as the type of material being used, desired method of joining components, or the required physical properties of the final part, including, but not limited to, dimensional accuracy, strength, and weight. These factors may be given appropriate weight for the particular application or use being considered.

Figure 5B:
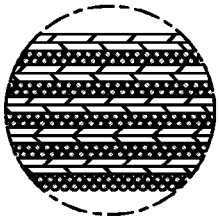

FIG. 5B provides a schematic illustration of the cross section of substantially planar material 20 for producing first members 28 (as shown in FIG. 5A). In this particular depiction, a multi-layered composite material is shown. However, it should be appreciated that any number of materials may be used for the construction of first members. For example, first members may be manufactured from titanium, aluminum, steel, stainless steel, or any other metal or alloy that may fit the design requirements of the components and subsequent space frame. Furthermore, first members may be made out of composite materials, carbon fiber, ceramics, polymers, cermets, or glass. Other materials not listed above may also be used to manufacture first members. Materials may be chosen for particular properties, including density, ease of manufacturing, strength, strength to weight ratios, cost, corrosion resistance, or desired methods for securing the interface or joining of components of the space frame.

Figure 6A:
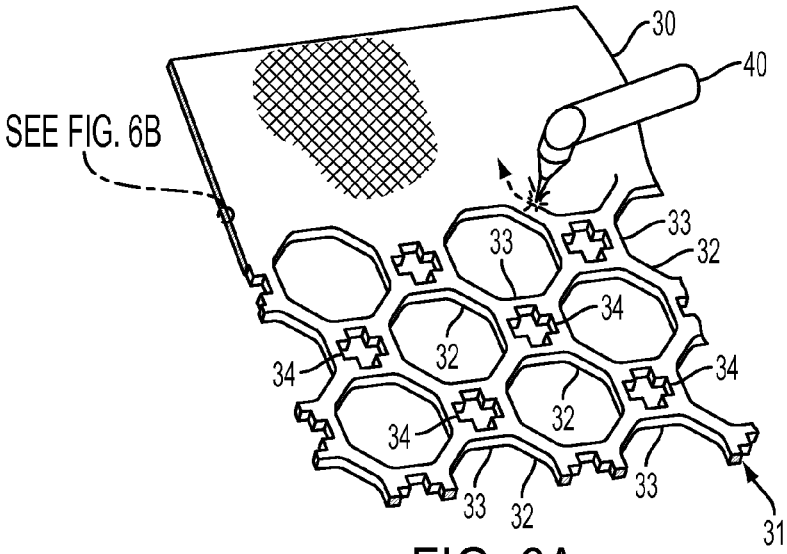
FIGS. 6A and 6B provide schematic illustrations of an embodiment of the process for manufacturing a lattice shape member or intermediate member.

FIG. 6A provides a schematic illustration of an aspect of an embodiment of the production of lattice shape member 31. A cutting tool 40 is used to cut and shape first members 28 from a substantially planar material 30. As shown in FIG. 6A, the cutting tool 40 may be employed in a single-step process to shape not only the general geometry of the lattice shape member 31, but to also cut out or otherwise form the struts 32, nodes 33, and mortise recesses 34. It should also be appreciated that the manufacturing process may involve a multi-step process, wherein the shape of the lattice shape member 31 is initially roughed out as it is formed from the substantially planar material 30. After this initial step, the subsequent details of the lattice shape member 31, including struts 32, nodes 33, and mortise recesses 34 may be shaped or formed in a subsequent step or steps that may or may not involve the machinery or manufacturing process of the initial step. It should be appreciated that this same, or a substantially similar process may be used to produce an intermediate member as shown in FIG. 3B.

Still referring to FIG. 6A, it should be appreciated that any number of processes may be applied to the manufacture of lattice shape member 31. The process of producing the lattice shape member 31 may include cutting, as with water jets, lasers, saws, or blades. The process of producing the lattice shape member 31 may also include machining processes, including but not limited to traditional machining processes such as milling and drilling, electro discharge machining, or any other machining process capable of forming the lattice shape member 31. Stamping processes may also be used to produce the lattice shape member 31. Once again, it is possible to produce an intermediate member 36 (as shown in FIG. 3B) with the same or substantially similar processes as may be used to produce a lattice shape member 31.

It should be appreciated that the lattice shape member or intermediate member may be made from any number of other processes, not all of which involve planar or substantially planar materials. For example, lattice shape members or intermediate members may be molded, cast, forged, 3D printed, formed through a sintering process, or any other method of manufacturing that is sufficient to produce lattice shape members or intermediate members of sufficient strength and with correct dimensional properties. The choice of manufacturing method may depend on such factors as the type of material being used, desired method of joining components, or the required physical properties of the final part, including, but not limited to, dimensional accuracy, strength, and weight. These factors may be given appropriate weight for the particular application or use being considered.

Figure 6B:
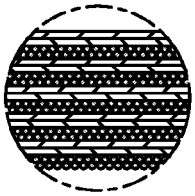

FIG. 6B provides a schematic illustration of the cross section of substantially planar material 30 for producing lattice shape members 31 (as shown in FIG. 6A) or intermediate members 36 (as shown in FIG. 3B). In this particular depiction, a multi-layered composite material is shown. However, it should be appreciated that any number of materials may be used for the construction of lattice shape members or intermediate members. For example, lattice shape members or intermediate members may be manufactured from titanium, aluminum, steel, stainless steel, or any other metal or alloy that may fit the design requirements of the components and subsequent space frame. Furthermore, lattice shape members or intermediate members may be made out of composite materials, carbon fiber, ceramics, polymers, cermets, or glass. Other materials not listed above may also be used to manufacture lattice shape members or intermediate members. Materials may be chosen for particular properties, including density, ease of manufacturing, strength, strength to weight ratios, cost, corrosion resistance, or desired methods for securing the interface or joining of components of the space frame. It should also be appreciated that a combination of materials may be used for particular applications. This combination could include combining first members of one material with lattice shape members or intermediate members of another material, or even having a portion of first members constructed from one material while another portion of first members is constructed from a different material. This may allow the final space frame to have different properties in one direction compared to another. Similarly, intermediate members or lattice shape members may be made of different materials in the same space frame. For instance, a more corrosion resistant lattice shape member or intermediate member may be used on the outer surfaces of the space frame, while a different material is used in the interior. It should be appreciated that any combination or placement of materials may be used in order to assemble or manufacture a space frame with the desired qualities.

Figure 7:
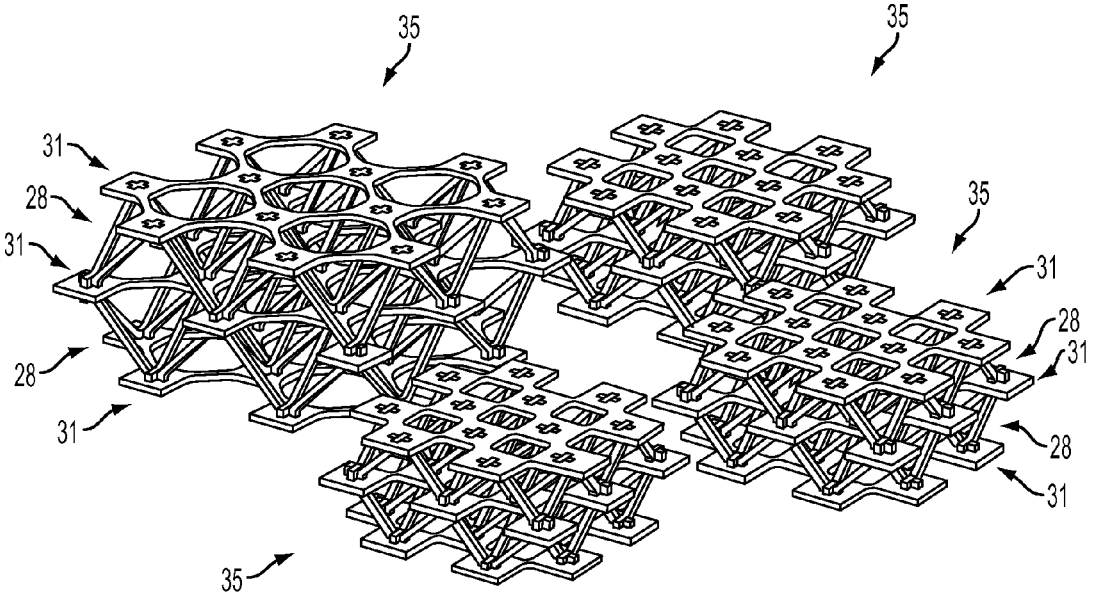
FIG. 7 provides a schematic illustration of embodiments of octet lattice truss structures assembled from components.

FIG. 7 provides a schematic illustration of several aspects of embodiments of the present invention. Four examples of an octet lattice truss structure 35 are depicted in FIG. 7. As can be seen, the octet lattice truss structures 35 may take on a variety of geometries and relative sizes. However, the octet lattice truss structures 35, despite having different relative sizes, are still assembled from the same basic components. Alternating layers of lattice shape members 31 and first members 28 are used to create the structures. By varying the relative sizes of the lattice shape members 31 and first members 28, different sizes of octet truss structures 35 can be made. FIG. 7 also illustrates that additional layers of lattice shape members 31 and first members 28 may be stacked in order to increase the height and size of the octet truss structures 35. Additional layers may be added as desired or required for any particular application. It should also be appreciated that the lattice shape members 31 may be substituted for by intermediate members 36 (as shown in FIG. 3B). Furthermore, the outermost lattice shape members 31 could be substituted for by intermediate members to provide planar outer surfaces to the space frame structures while still retaining the lighter weight of a lattice shape member 31 in the interior of the structure. Similarly, it should also be appreciated that only a portion of a layer of lattice shape members 31 may be substituted for by intermediate members 36 (as shown in FIG. 3B).

Figure 8:
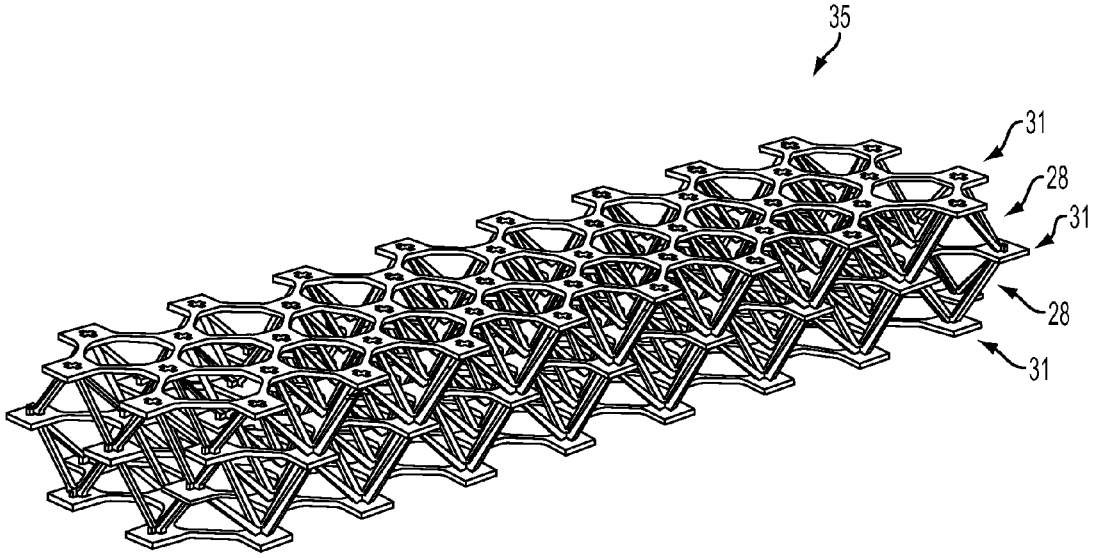
FIG. 8 provides a schematic illustration of an embodiment of an octet lattice truss structure assembled from components.

FIG. 8 provides a schematic illustration of an aspect of an embodiment of the present invention. As shown, the octet lattice truss structure 35 (or any similar space frame structure) may be scaled laterally as well as vertically. Not only may the octet lattice truss structure 35 grow by the subsequent stacking of lattice shape members 31 interspersed with first members 28, but it may also expand laterally by the increase in size of the lattice shape members 31 and or first members 28. It should also be appreciated that an increase in the lateral dimensions may be achieved by the incorporation of additional first members 28 or lattice shape members 31 next to one another. For example, the top layer of the octet lattice truss structure 35 could be constructed of multiple lattice shape members 31. This is also true of the lower and intermediate lattice shape member layers 31. The interconnection of multiple lattice shape members 31 in any individual layer of the octet lattice truss structure 35 with the first members 28 would prevent the overall structure from separating in a lateral direction. Furthermore, it should be appreciated that this sectioning could also take place in any layer made of first members 28, wherein multiple first members 28 are lined up end to end to create a longer structure. It is even possible to have layers with multiple sectioned first members 28 and layers with multiple sectioned lattice shape members 31 in the same space frame or octet lattice truss structure 35. So long as the seams between the sectional first members 28 and the sectional lattice shape members 31 do not align (i.e., the seams are staggered), the space frame or octet lattice truss structure 35 will remain a cohesive whole. It should be noted that in the embodiments described above, an intermediate member 36 (as shown in FIG. 3B) may substitute for any lattice shape member 31, either as a whole or in sections.

Still referring to FIG. 8, it should be appreciated that the scaling of a space frame or octet lattice truss structure 35 may be achieved by producing smaller portions of the octet lattice structure 35 and then attaching these multiple smaller structures together. This can be achieved both laterally and vertically. Any bonding or attachment means that will satisfy the particular requirements of the application, such as strength, temperature resistance, weight, or ease of manufacture may be used to connect or attach multiple structures. This allows for smaller octet lattice truss structures 35 or, more generally, space frames, to be built up or assembled into larger structures.

Still referring to FIG. 8, it should be appreciated that the octet lattice truss structure 35, or, more generally, a space frame, may have varying sizes of unit cells throughout its structure. As illustrated, the octet lattice truss structure 35 has identical or nearly identical unit cell sizes across its length, width, and height. The size of a unit cell is determined by the relative proportions of the lattice shape member 31 (or alternatively intermediate member) and the first members 28 and their constituent sub-parts or structures. As shown, the lattice shape members 31 and first members 28 maintain their respective geometries throughout the structure. However, it should be appreciated that these geometries could vary along any dimension of the structure to create, for example, a central area with relatively larger unit cell dimensions and peripheral areas with relatively smaller unit cell dimensions (or vice-versa, or combination thereof). So long as the alignment of connecting parts, such as tenon or tenon-like structures with mortise recesses, remains proper, the structure may vary in unit cell size as desired or required for any particular application.

Figure 9:
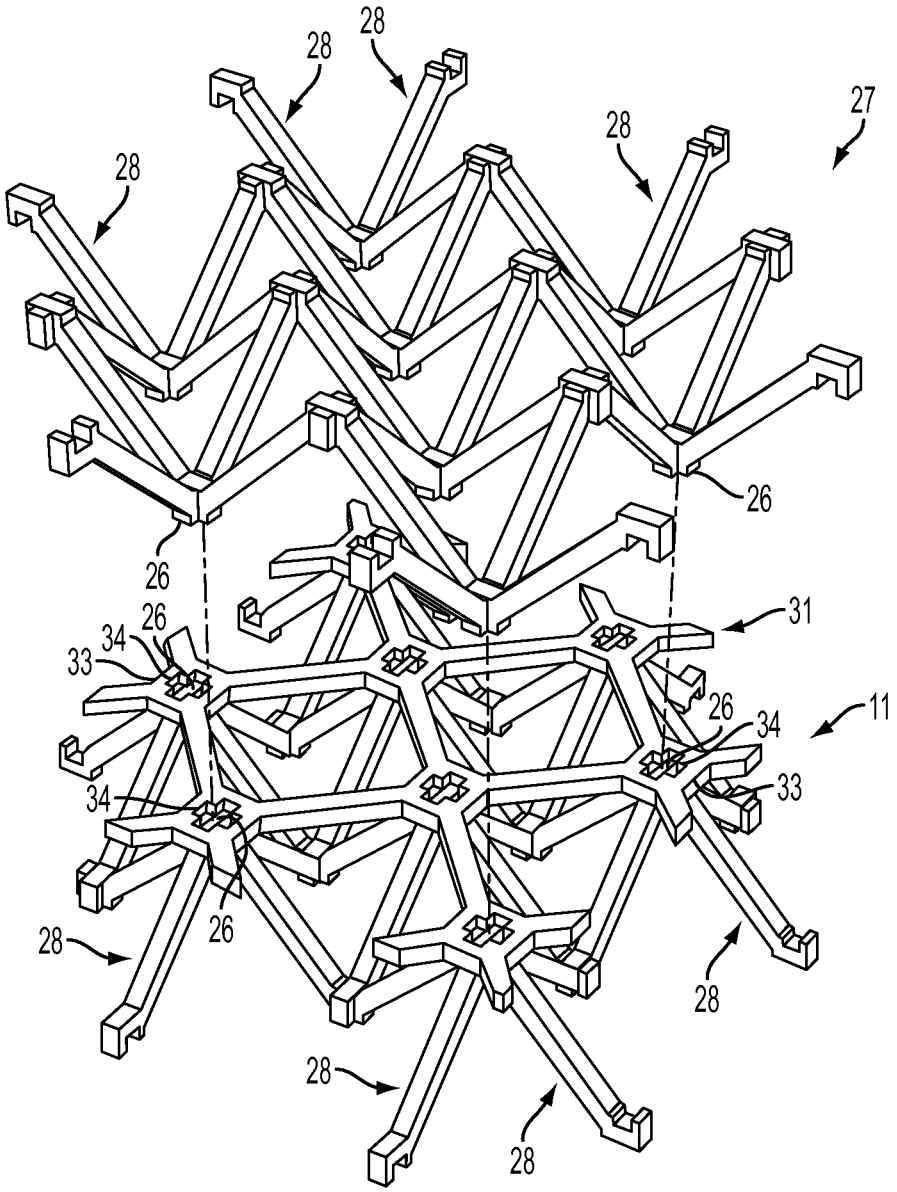
FIG. 9 provides a schematic illustration of an embodiment of the process for assembling a space frame from components.

FIG. 9 provides a schematic illustration of the assembly of multiple layers of an aspect of an embodiment of the present invention. In this illustration, a space frame 11 has already been assembled from constituent components. An array of first members 28 are in communication with a lattice shape member 31 and aligned so that the tenon or tenon-like structures 26 may interface or fit with the mortise recesses 34 and their respective nodes 33. As can be seen in FIG. 9, the tenon or tenon-like structures of the lower set of arrayed first members 28 do not pass fully through or penetrate the mortise recesses 34 of the lattice shape member 31. A second layer of first members 28 that have been arranged into an intersecting array structure 27 are shown above the space frame 11. The intersecting array structure 27 and its respective tenon or tenon-like structures 26 may then be aligned and positioned so as to interface or fit with the mortise recesses 34 of the lattice shape member 31. A second lattice shape member (not shown) may then be placed on top of the intersecting array structure 27, aligning mortise recesses with tenon or tenon-like structures 26. The successive addition of more layers may then be repeated as necessary to construct a space frame 11 of any height required by the user. It should be appreciated that in any respective layer of the space frame 11, an intermediate member 36 (as shown in FIG. 3B) may substitute for the lattice shape member 31.

Figure 10A:
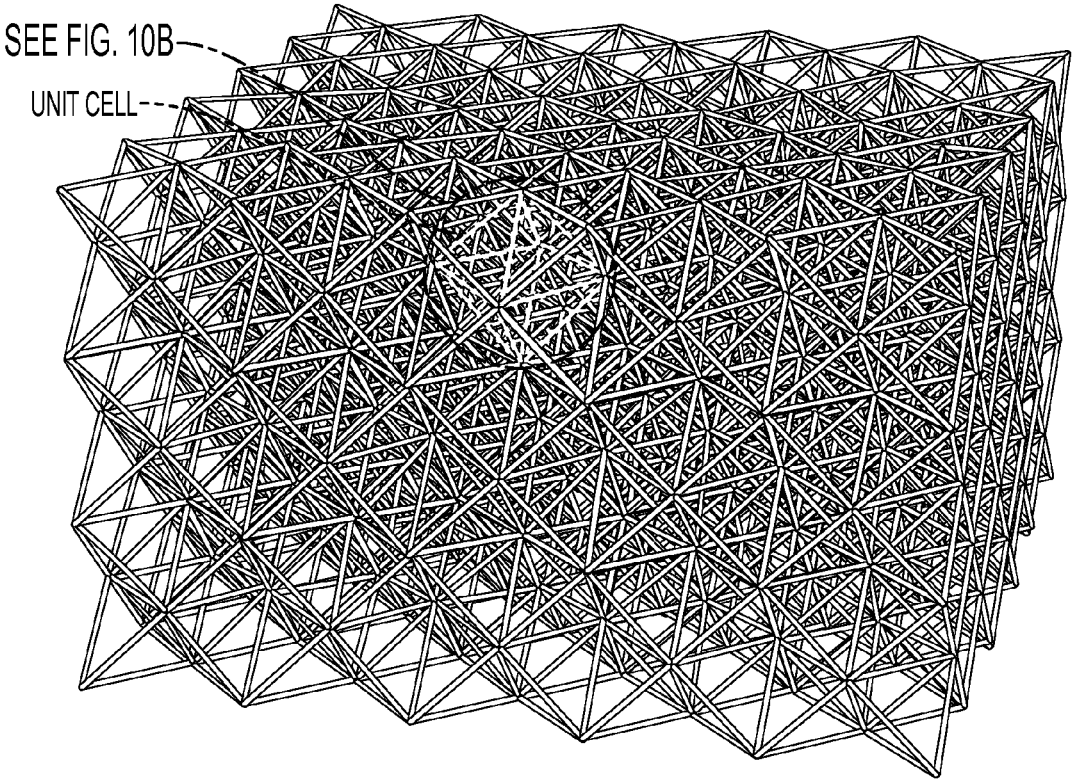
FIGS. 10A and 10B provide schematic illustrations of an embodiment of an octet lattice truss structure and an octet lattice truss unit cell.
Figure 10B:
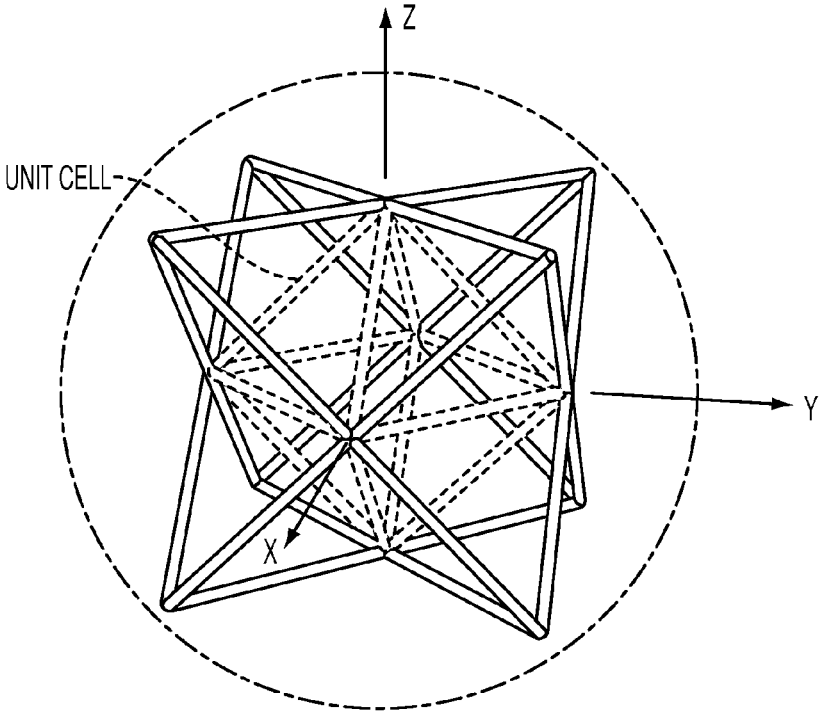

FIG. 10A provides a schematic illustration of an octet truss lattice constructed by three-dimensional packing of unit cells. FIG. 10B provides a schematic illustration of a unit cell of the face centered cubic crystal symmetry octet truss lattice. The unit cell is composed of a center octahedral cell in communication with edge tetrahedral cells.

Figure 11A:
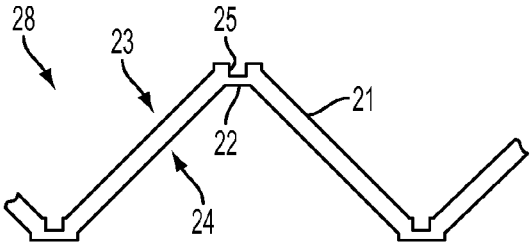
FIGS. 11A-11C provide schematic illustrations of embodiments of components of an octet truss structure and an octet lattice truss unit cell.

FIG. 11A provides a schematic illustration of a first member 28 of an aspect of an embodiment of the present invention. The first member 28 is shown with an anterior 23 and posterior surfaces 24. The first member 28 is composed of inflection areas 22 with inflection recesses 25 connected by alternating struts 21.

Figure 11B:
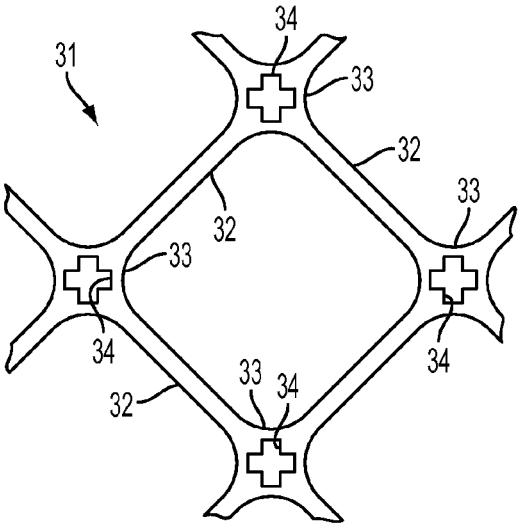

FIG. 11B provides a schematic illustration of a lattice shape member 31 of an aspect of an embodiment of the present invention. The lattice shape member 31 is shown with nodes 33 having mortise recesses 34 connected by struts 32.

Figure 11C:
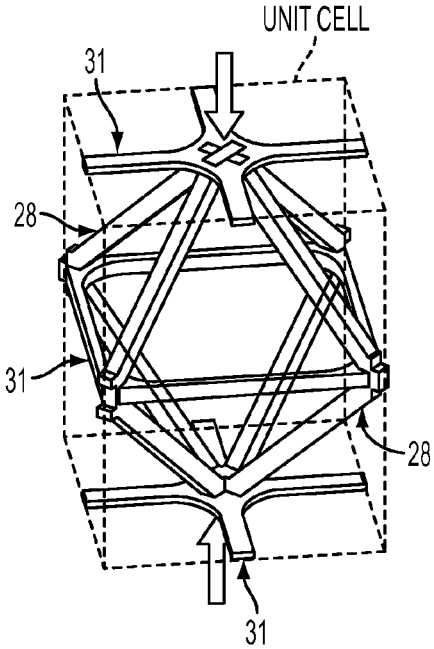

FIG. 11C provides a schematic illustration of the unit cell of an octet lattice truss structure constructed of from several first members 28 (as shown in FIG. 11A) interspersed and interfacing with several lattice shape members 31 (as shown in FIG. 11B). As shown, the particular geometry of the first members 28 and lattice shape members 31 allow for the formation of an octet lattice unit cell which may be repeated to form a space frame.

Figure 12B:
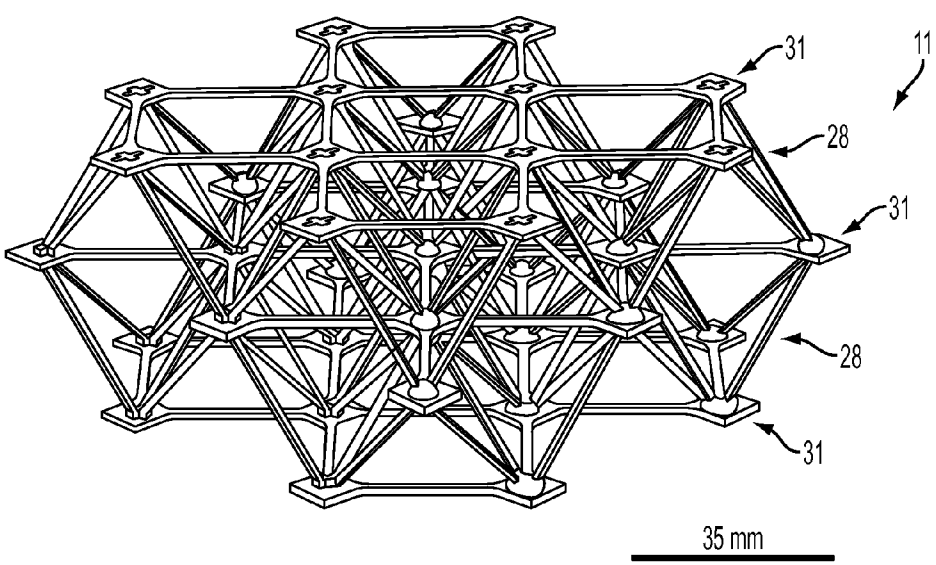
FIGS. 12A-12D provide schematic illustrations of embodiments of a lattice shape member and truss structures.
Figure 12A:
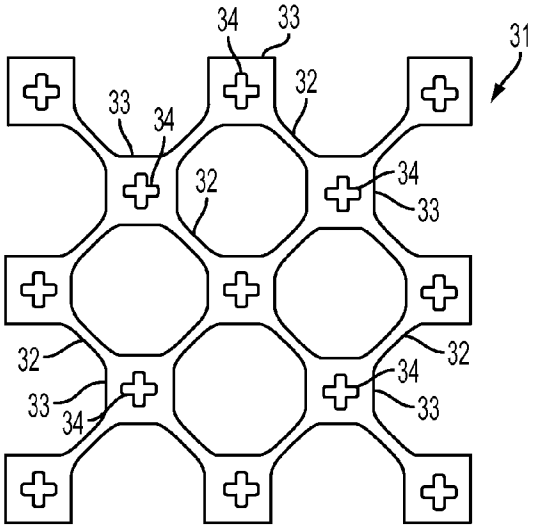

FIG. 12A provides a schematic illustration (e.g., plan view) of a lattice shape member 31 from an aspect of an embodiment of the present invention. The lattice shape member 31 is composed of struts 32 which locate nodes 33 which contain the mortise shape recesses 34. The particular geometry of the struts 32, nodes 33, and mortise shape recesses 34 may be varied as desired or required to provide a space frame of any shape, and to ensure proper alignment of the mortise recesses 34 with the tenon or tenon-like structures that it will interface with.

FIG. 12B provides a perspective schematic illustration of a space frame 11 that comprises an aspect of an embodiment of the present invention. As shown, the space frame 11 is assembled from alternating layers of lattice shape members 31 and first members 28.

Figure 12D:
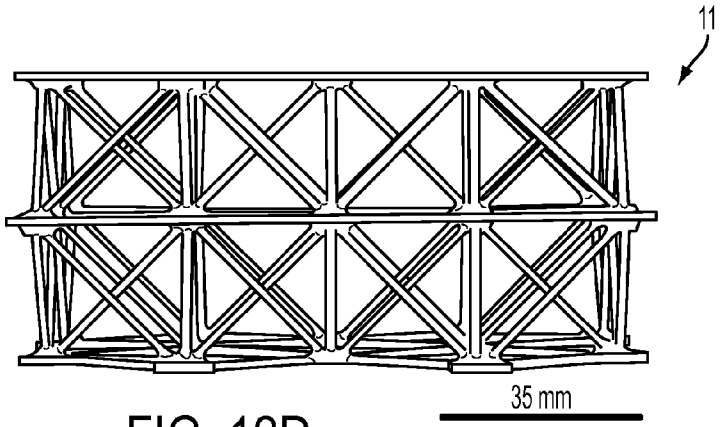
Figure 12C:
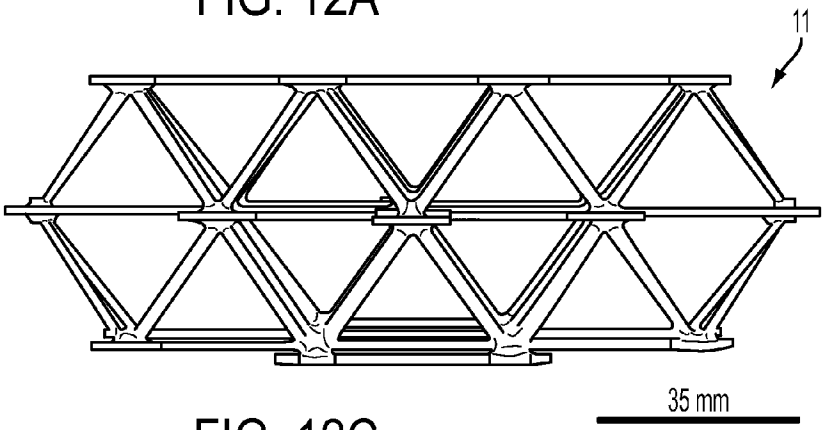

FIG. 12C provides a schematic illustration of the space frame 11 of FIG. 12B as seen from a vantage point that is parallel to the plane of the lattice shape members 31 (as seen in FIG. 12B).

FIG. 12D provides a schematic illustration of the space frame of 11 of FIG. 12B as seen from a vantage point that is parallel to the plane of the lattice shape members 31 (as seen in FIG. 12B) but oriented at a right angle to the perspective of FIG. 12C.

Figure 13C:
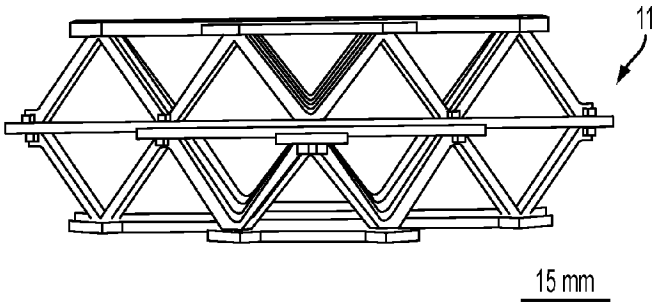
FIGS. 13A-13D provide schematic illustrations of embodiments of space frames assembled from components.
Figure 13D:
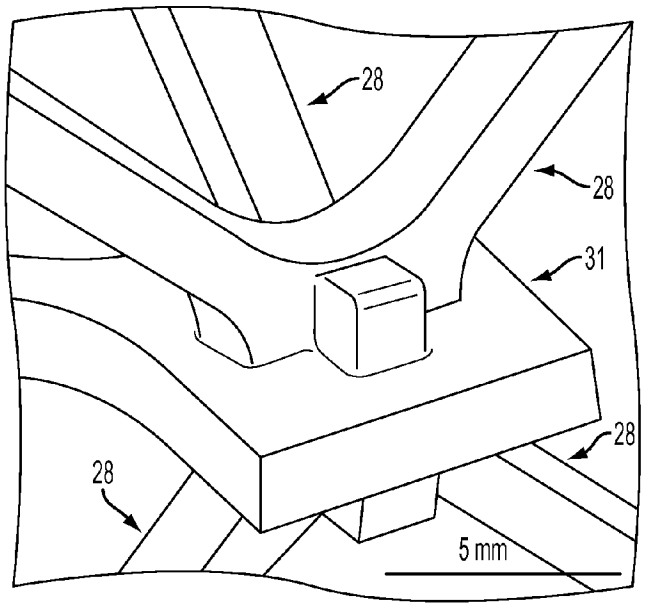
Figure 13A:
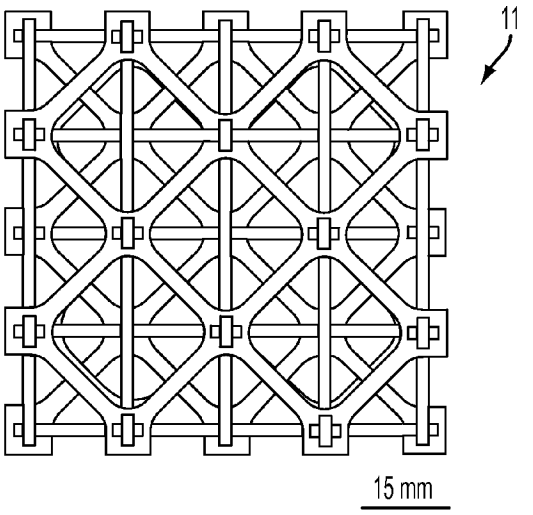

FIG. 13A provides a schematic illustration of a space frame 11 of an aspect of an embodiment of the present invention. The space frame 11 is shown from a perspective that is perpendicular to the plane of the lattice shape members.

Figure 13B:
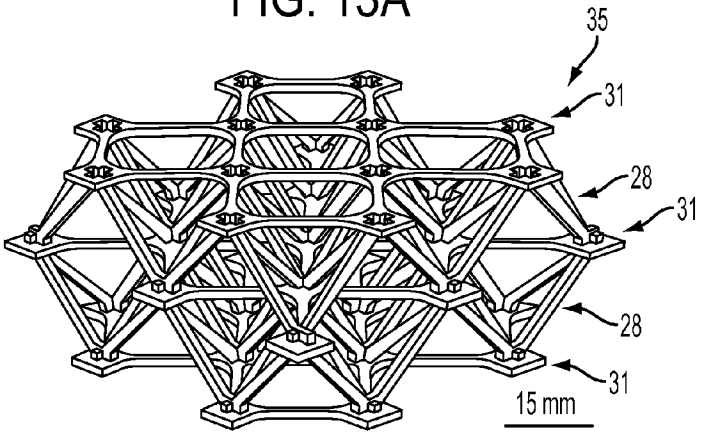

FIG. 13B provides a perspective schematic illustration of an octet lattice truss structure 35 of an aspect of an embodiment of the present invention. The octet lattice truss structure 35 is composed of alternating layers of lattice shape members 31 interspersed and interfacing with layers of arrayed first members 28.

FIG. 13C provides a schematic illustration of a space frame 11 of an aspect of an embodiment of the present invention. The space frame 11 is viewed from a vantage point that is parallel to the plane of the lattice shape members.

FIG. 13D provides a schematic illustration of the joint or interface between a lattice shape member 31 and several first members 28 of an aspect of an embodiment of the present invention. The lattice shape member 31 is in communication with two first members 28 positioned above the lattice shape member 31. Similarly, the lattice shape member 31 is also in communication with two more first members 28, positioned below the lattice shape member 31. The two upper first members 28 intersect or interface to create a tenon or tenon-like structure (not numbered) which interfaces with the node (not numbered) and mortise recess (not numbered) of the lattice shape member 31. The two lower first members 28 also intersect or interface to create a tenon or tenon-like structure (not numbered) which approaches the node (not numbered) and mortise recess (not numbered) from below. The two tenon or tenon-like structures then may both interface with the node and mortise recess of the lattice shape member 31 at the same time.

Figure 14:
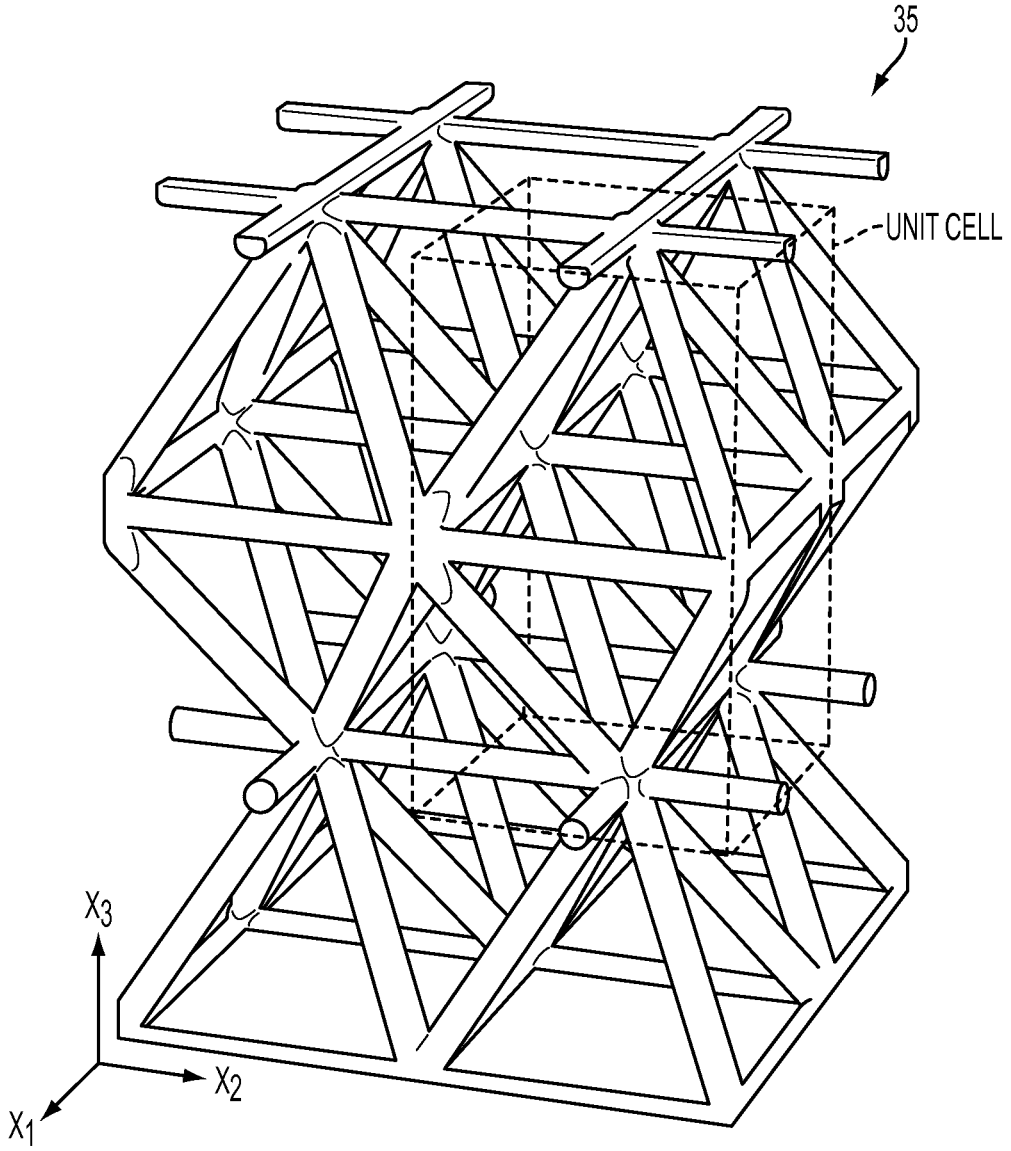
FIG. 14 provides a schematic illustration of an embodiment of an octet truss structure.

FIG. 14 provides a schematic illustration of a portion of an octet lattice truss structure 35 of an aspect of an embodiment of the present invention. A unit cell of the octet lattice truss structure is highlighted in dashed lines. It should be appreciated that the cross section of the elements which make up the octet lattice truss structure 35 is circular. The present invention contemplates that octet lattice truss structures, and more generally space frames, may be composed of elements of any cross section shape or size and are not limited only to those particularly shown or described above.

Figures 15A, 15B:
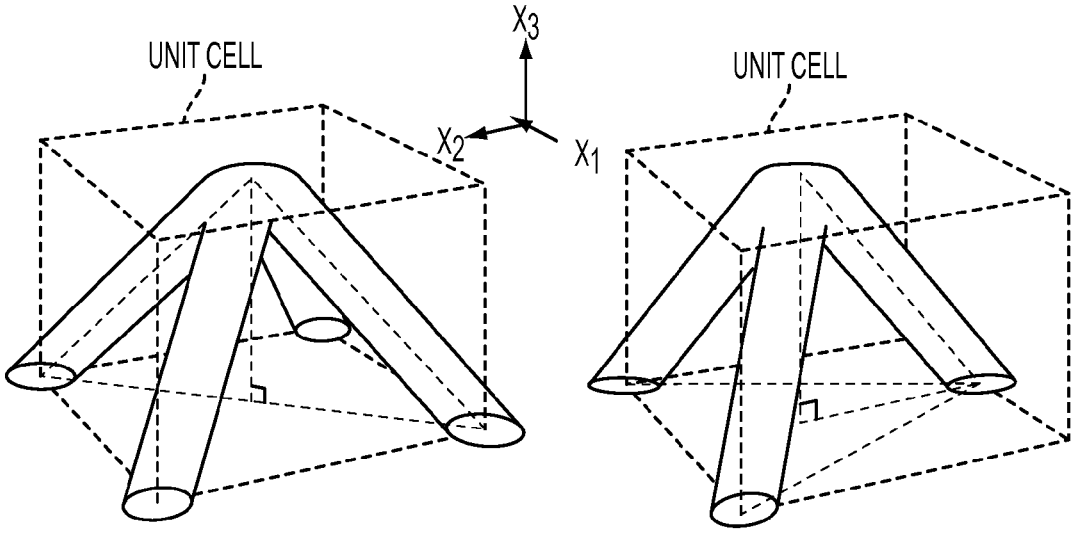
FIGS. 15A-15B provide schematic illustrations of embodiments of space frame unit cells.

FIG. 15A provides a schematic illustration of a pyramidal lattice unit cell with four struts of an aspect of an embodiment of the present invention. FIG. 15B provides a schematic illustration of a tetrahedral lattice unit cell with three struts of an aspect of an embodiment of the present invention. It should be appreciated that space frames composed of many different types of unit cells are possible using the instant method and devices as described in the present invention. For example, space frames composed of octet unit cells, octahedral unit cells, cubic unit cells, pyramidal unit cells, or diamond unit cells may be constructed using the methods and devices of the present invention. Furthermore, other unit cells not listed above may also be constructed. The choice of unit cells may be influenced by the particular application of the space frame, the desired density of the space frame, material of construction, or any other considerations which may affect the final properties or performance of the device. Construction of a space frame composed of any kind of unit cell may be accomplished by altering the specific geometry of first members, lattice shape members, and or intermediate members to achieve the correct geometry, orientation, and dimensions of both the overall space frame and its constituent unit cells.

Figure 16A:
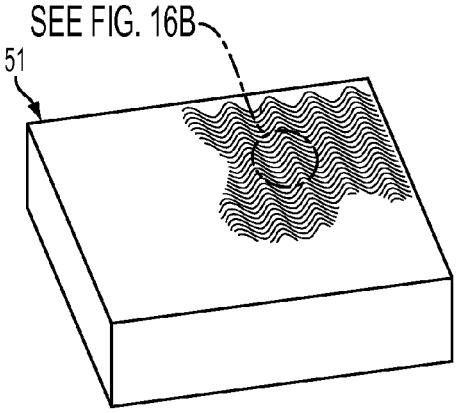
FIGS. 16A-16D provide schematic illustrations of an embodiment of a process for forming first members.

FIG. 16A provides a schematic illustration of an aspect of an embodiment of the manufacture of first members 28 (not shown) of the present invention. A negative die 51 for producing first members 28 (not shown) is provided. FIG. 16B provides an enlarged view of negative die shapes 52 for producing first members 28 (not shown), which are present on the positive die 51 for producing first members 28 (not shown).

Figure 16C:
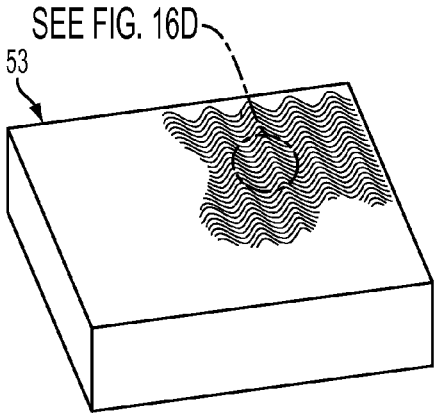
Figure 16B:
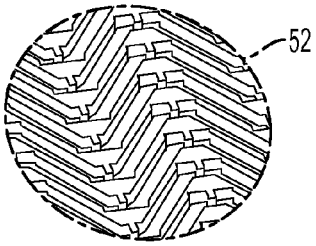
Figure 16D:
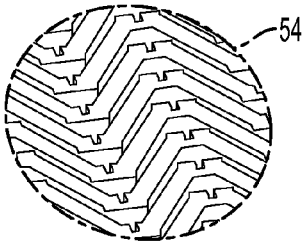

FIG. 16C provides a schematic illustration of an aspect of an embodiment of the manufacture of first members 28 (not shown) of the present invention. A positive die 53 for producing first members 28 (not shown) is provided. FIG. 16D provides an enlarged view of positive die shapes 54 for producing first members 28 (not shown), which are present on the positive die 53 for producing first members 28 (not shown).

Figure 17A:
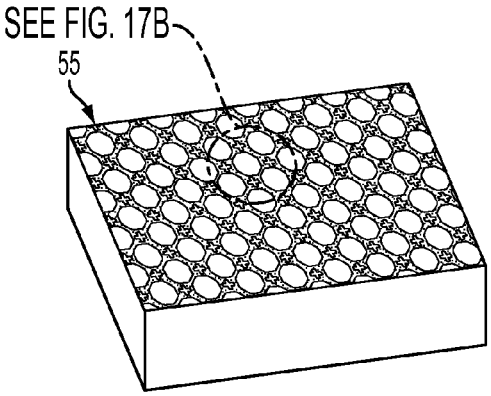
FIGS. 17A-17D provide schematic illustrations of an embodiment of a process for forming lattice shape members or intermediate members.

FIG. 17A provides a schematic illustration of an aspect of an embodiment of the manufacture of lattice shape members or intermediate members of the present invention. A negative die 55 for producing lattice shape members 31 (not shown) or intermediate members 55 (not shown). FIG. 17B provides an enlarged view of negative die shapes 56 for producing lattice shape members 31 (not shown) or intermediate members 36 (not shown).

Figure 17C:
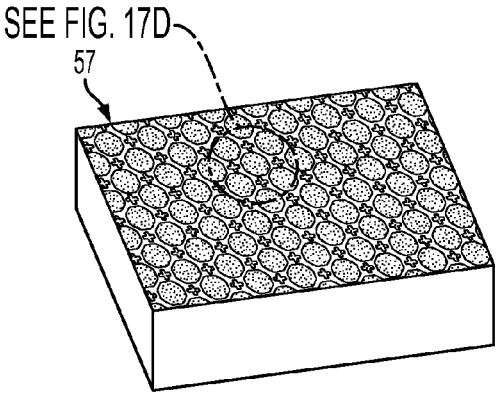
Figure 17B:
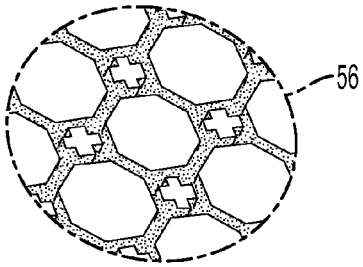
Figure 17D:
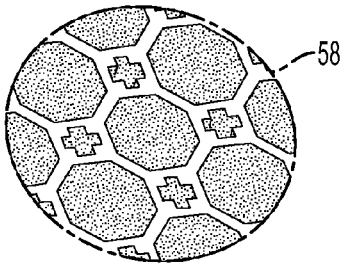

FIG. 17C provides a schematic illustration of an aspect of an embodiment of the manufacture of lattice shape members 31 (not shown) or intermediate members 36 (not shown) of the present invention. A positive die 57 for producing lattice shape members 31 (not shown) or intermediate members 36 (not shown) is provided. FIG. 17D provides an enlarged view of positive die shapes 58 for producing lattice shape members 31 (not shown) or intermediate members 36 (not shown), which are present on the positive die 57 for producing lattice shape members 31 (not shown) or intermediate members 57 (not shown).

It should be appreciated that these dies, both positive and negative, may be used in conjunction with any material, solid, liquid, or powdered, in order to form first members, intermediate members, or lattice shape members that may be used to assemble a space frame. It should also be appreciated that the design of the positive die shapes and negative die shapes should be configured so as to match properly with their respective partner shapes and that they should be shaped so as to accurately reproduce the desired geometry of the manufactured parts.

Figure 18:
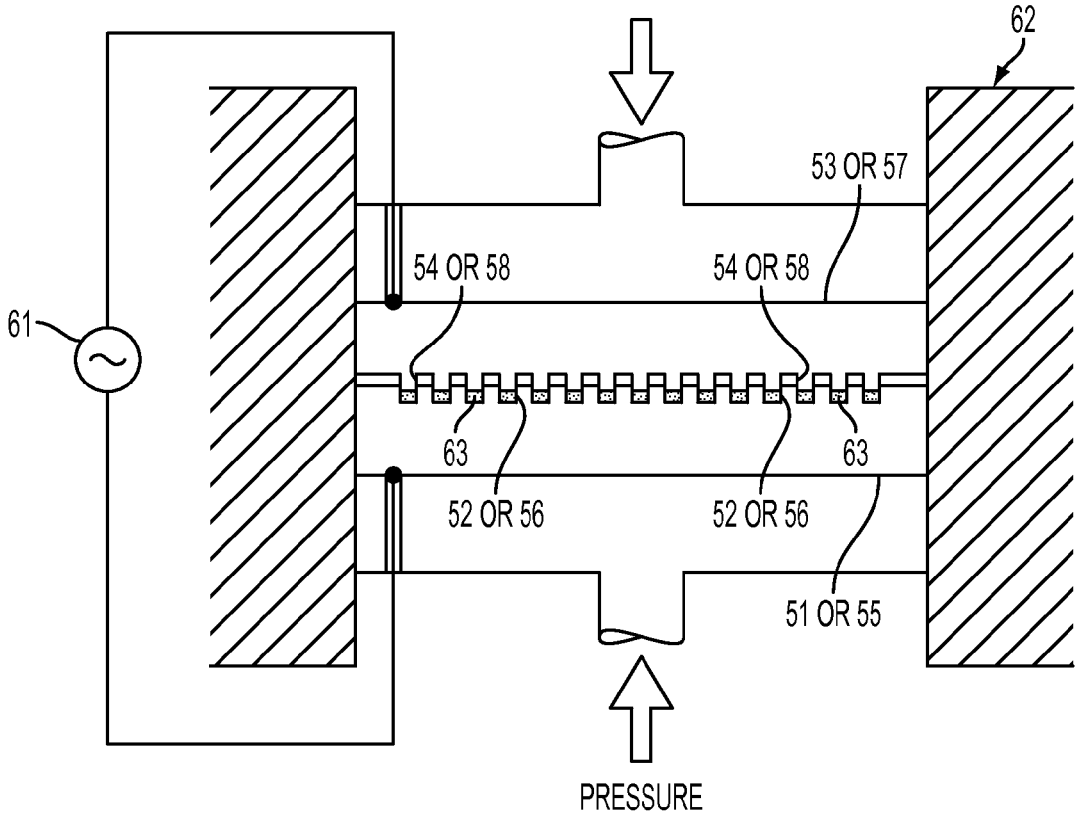
FIG. 18 provides a schematic illustration of an embodiment of a process for forming components of a space frame.

FIG. 18 provides a schematic illustration of the manufacture of components of an aspect of an embodiment of the present invention. A press 62 is shown in conjunction with a power supply 61. A negative die 51 for producing first members 28 (not shown) or a negative die 55 for producing lattice shape members 31 (not shown) or intermediate members 36 (not shown) may be loaded into the press 62 and filled with a material 63 within the negative die shapes 52 or 56. The corresponding positive die 53 for producing first members 28 (not shown) or positive die 57 for producing lattice shape members 31 (not shown) or intermediate members 36 (not shown) is also loaded into the press 62. The positive die 53 or 57 is oriented so that the positive die shapes 54 or 58 will be oriented and positioned appropriately to interface with their corresponding negative die shapes 52 or 56. The press is then operated to apply pressure, and optionally heat or electricity, to the dies to form and solidify the components that will then be used to assemble a space frame. It should be appreciated that this process may be used with any number of materials, including solids, liquids, or powders, metals, ceramics, glasses, polymers, composites, or any other material that is amenable to this type of manufacturing process. It should also be appreciated that the power supply 61 may be any type of power supply, including a constant, pulsing, or variable power supply. Also, the power supply 61 may be used to apply heat or electricity directly or indirectly to the dies and or press.

EXAMPLES

Practice of an aspect of an embodiment (or embodiments) of the invention will be still more fully understood from the following examples, which are presented herein for illustration only and should not be construed as limiting the invention in any way.

Example 1

A method for producing a space frame. The method may comprise:

a) providing a plurality of first members comprising alternating linear struts with inflection areas between said alternating linear struts, said first members having an anterior surface and a posterior surface, a recess at each said inflection area of said first members to define an inflection recess, all of said inflection recesses disposed along said anterior surface of said first member;

b) arranging said plurality of said first members into an array with a first portion of said plurality of said first members arrayed substantially parallel to one another; and arranging a second portion of said plurality of said first members arrayed substantially orthogonal to said arrayed first portion of said plurality of said first members, so as to define an intersecting array structure;

wherein said first portion of said plurality of said first members is inverted with respect to said second portion of said plurality of said first members so that said anterior surfaces of said first portion of said plurality of said first members may be in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure;

c) providing a lattice shape member comprising struts disposed between nodes, each of said nodes having a mortise recess configured to interface with said tenon or tenon-like structures, said struts configured such that said nodes are located such that said mortise recesses are properly spaced so as to communicate with said tenons or tenon-like structures from the array comprised of said plurality of said first members; and d) disposing said lattice shape member such that said mortise recess of said nodes are in communication with said tenons or tenon-like structures to provide a space frame.

Example 2

The method of example 1, wherein said providing a plurality of first members comprises:

producing said plurality of first members from a substantially planar material.

Example 3

The method of example 2, wherein said producing includes cutting.

Example 4

The method of example 2 (as well as subject matter of example 3), wherein said producing includes machining.

Example 5

The method of example 2 (as well as subject matter of one or more of any combination of examples 3-4), wherein said producing includes stamping.

Example 6

The method of example 1 (as well as subject matter of one or more of any combination of examples 2-5), wherein said providing a plurality of first members comprises molding said plurality of first members.

Example 7

The method of example 1 (as well as subject matter of one or more of any combination of examples 2-6), wherein said providing a plurality of first members comprises casting said plurality of first members.

Example 8

The method of example 1 (as well as subject matter of one or more of any combination of examples 2-7), wherein said providing a plurality of first members comprises forging said plurality of first members.

Example 9

The method of example 1 (as well as subject matter of one or more of any combination of examples 2-8, wherein said providing a plurality of first members comprises sintering said plurality of first members.

Example 10

The method of example 1 (as well as subject matter of one or more of any combination of examples 2-9), wherein said providing a lattice shape member comprises:

producing said lattice shape member from a substantially planar material.

Example 11

The method of example 10 (as well as subject matter of one or more of any combination of examples 2-10), wherein said producing includes cutting.

Example 12

The method of example 10 (as well as subject matter of one or more of any combination of examples 2-11), wherein said producing includes machining.

Example 13

The method of example 10 (as well as subject matter of one or more of any combination of examples 2-12), wherein said producing includes stamping.

Example 14

The method of example 1 (as well as subject matter of one or more of any combination of examples 2-13), wherein said providing a lattice shape member comprises molding said lattice shape member.

Example 15

The method of example 1 (as well as subject matter of one or more of any combination of examples 2-14), wherein said providing a lattice shape member comprises casting said lattice shape member.

Example 16

The method of example 1 (as well as subject matter of one or more of any combination of examples 2-15), wherein said providing a lattice shape member comprises forging said lattice shape member.

Example 17

The method of example 1 (as well as subject matter of one or more of any combination of examples 2-16), wherein said providing a lattice shape member comprises sintering said lattice shape member.

Example 18

The method of example 1 (as well as subject matter of one or more of any combination of examples 2-17), wherein at least a portion of said space frame comprises titanium.

Example 19

The method of example 1 (as well as subject matter of one or more of any combination of examples 2-18), wherein at least a portion of said space frame comprises aluminum.

Example 20

The method of example 1 (as well as subject matter of one or more of any combination of examples 2-19), wherein at least a portion of said space frame comprises steel.

Example 21

The method of example 1 (as well as subject matter of one or more of any combination of examples 2-20), wherein at least a portion of said space frame comprises a metal.

Example 22

The method of example 1 (as well as subject matter of one or more of any combination of examples 2-21), wherein at least a portion of said space frame comprises an alloy.

Example 23

The method of example 1 (as well as subject matter of one or more of any combination of examples 2-22), wherein at least a portion of said space frame comprises stainless steel.

Example 24

The method of example 1 (as well as subject matter of one or more of any combination of examples 2-23), wherein at least a portion of said space frame comprises carbon fiber.

Example 25

The method of example 1 (as well as subject matter of one or more of any combination of examples 2-24), wherein at least a portion of said space frame comprises a ceramic.

Example 26

The method of example 1 (as well as subject matter of one or more of any combination of examples 2-25), wherein at least a portion of said space frame comprises a polymer.

Example 27

The method of example 1 (as well as subject matter of one or more of any combination of examples 2-26), wherein at least a portion of said space frame comprises a cermet.

Example 28

The method of example 1 (as well as subject matter of one or more of any combination of examples 2-27), wherein at least a portion of said space frame comprises a glass.

Example 29

The method of example 1 (as well as subject matter of one or more of any combination of examples 2-28), wherein at least a portion of said space frame comprises a composite material.

Example 30

The method of example 1 (as well as subject matter of one or more of any combination of examples 2-29), wherein said tenon or tenon-like structure provides an interface that comprises a joint.

Example 31

The method of example 1 (as well as subject matter of one or more of any combination of examples 2-30), wherein said tenon or tenon-like structure provides an interface that comprises a halved-joint.

Example 32

The method of example 1 (as well as subject matter of one or more of any combination of examples 2-31), wherein said tenon or tenon-like structure provides an interface that is brazed.

Example 33

The method of example 1 (as well as subject matter of one or more of any combination of examples 2-32), wherein said tenon or tenon-like structure provides an interface that is bonded.

Example 34

The method of example 1 (as well as subject matter of one or more of any combination of examples 2-33), wherein said tenon or tenon-like structure provides an interface that is glued.

Example 35

The method of example 1 (as well as subject matter of one or more of any combination of examples 2-34), wherein said tenon or tenon-like structure provides an interface that is diffusion bonded.

Example 36

The method of example 1 (as well as subject matter of one or more of any combination of examples 2-35), wherein said tenon or tenon-like structure provides an interface that is held together by sintered powder.

Example 37

The method of example 1 (as well as subject matter of one or more of any combination of examples 2-36), wherein said tenon or tenon-like structure provides an interface that is epoxied.

Example 38

The method of example 1 (as well as subject matter of one or more of any combination of examples 2-37), wherein said tenon or tenon-like structure provides an interface that is pinned.

Example 39

The method of example 1 (as well as subject matter of one or more of any combination of examples 2-38), wherein said tenon or tenon-like structure provides an interface that is wedged.

Example 40

The method of example 1, (as well as subject matter of one or more of any combination of examples 2-39), wherein said inflection recesses snap together to form a tenon or tenon-like structure.

Example 41

The method of example 1 (as well as subject matter of one or more of any combination of examples 2-40), wherein a friction fit of said inflection recesses form a tenon or tenon-like structure.

Example 42

The method of example 1 (as well as subject matter of one or more of any combination of examples 2-41), wherein an interference fit of said inflection recesses form a tenon or tenon-like structure.

Example 43

The method of example 1 (as well as subject matter of one or more of any combination of examples 2-42), wherein said communication of said mortise recess and said tenons or tenon-like structures comprises a joint.

Example 44

The method of example 43 (as well as subject matter of one or more of any combination of examples 2-43), wherein said joint is brazed.

Example 45

The method of example 43 (as well as subject matter of one or more of any combination of examples 2-44), wherein said joint is bonded.

Example 46

The method of example 43 (as well as subject matter of one or more of any combination of examples 2-45), wherein said joint is glued.

Example 47

The method of example 43 (as well as subject matter of one or more of any combination of examples 2-46), wherein said joint is diffusion bonded.

Example 48

The method of example 43 (as well as subject matter of one or more of any combination of examples 2-47), wherein said joint is held together by sintered powder.

Example 49

The method of example 43 (as well as subject matter of one or more of any combination of examples 2-48), wherein said joint is epoxied.

Example 50

The method of example 43 (as well as subject matter of one or more of any combination of examples 2-49), wherein said joint is pinned.

Example 51

The method of example 43 (as well as subject matter of one or more of any combination of examples 2-50), wherein said joint is wedged.

Example 52

The method of example 43 (as well as subject matter of one or more of any combination of examples 2-51), wherein said joint snaps together.

Example 53

The method of example 43 (as well as subject matter of one or more of any combination of examples 2-52), wherein said joint comprises a friction fit.

Example 54

The method of example 43 (as well as subject matter of one or more of any combination of examples 2-53), wherein said joint comprises an interference fit.

Example 55

The method of example 1 (as well as subject matter of one or more of any combination of examples 2-54), wherein said space frame comprises a plurality of octet unit cells.

Example 56

The method of example 1 (as well as subject matter of one or more of any combination of examples 2-55), wherein said space frame comprises a plurality of octahedron unit cells.

Example 57

The method of example 1 (as well as subject matter of one or more of any combination of examples 2-56), wherein said space frame comprises a plurality of cubed unit cells.

Example 58

The method of example 1 (as well as subject matter of one or more of any combination of examples 2-57), wherein said space frame comprises a plurality of pyramid unit cells.

Example 59

The method of example 1 (as well as subject matter of one or more of any combination of examples 2-58), wherein said space frame comprises a plurality of tetrahedron unit cells.

Example 60

The method of example 1 (as well as subject matter of one or more of any combination of examples 2-59), wherein said space frame comprises a plurality of diamond unit cells.

Example 61

The method of example 1 (as well as subject matter of one or more of any combination of examples 2-60), wherein said inflection recesses are configured to interface with other said inflection recesses.

Example 62

The method of example 1 (as well as subject matter of one or more of any combination of examples 2-61), wherein at least one of said inflection recesses of comprises a slot.

Example 63

The method of example 1 (as well as subject matter of one or more of any combination of examples 2-62), wherein at least one of said inflection recesses comprises a notch.

Example 64

The method of example 1 (as well as subject matter of one or more of any combination of examples 2-63), wherein at least one of said inflection recesses comprises a groove.

Example 65

The method of example 1 (as well as subject matter of one or more of any combination of examples 2-64), wherein at least one of said inflection recesses comprises an aperture.

Example 66

The method of example 1 (as well as subject matter of one or more of any combination of examples 2-65), wherein at least one of said inflection recesses comprises a passage.

Example 67

The method of example 1 (as well as subject matter of one or more of any combination of examples 2-66), wherein at least one of said mortise recesses comprises a slot.

Example 68

The method of example 1 (as well as subject matter of one or more of any combination of examples 2-67), wherein at least one of said mortise recesses comprises a notch.

Example 69

The method of example 1 (as well as subject matter of one or more of any combination of examples 2-68), wherein at least one of said mortise recesses comprises a groove.

Example 70

The method of example 1 (as well as subject matter of one or more of any combination of examples 2-69), wherein at least one of said mortise recesses comprises an aperture.

Example 71

The method of example 1 (as well as subject matter of one or more of any combination of examples 2-70), wherein at least one of said mortise recesses comprises a passage.

Example 72

The method of example 1 (as well as subject matter of one or more of any combination of examples 2-71), wherein at least one of said mortise recesses passes fully through said lattice shape member.

Example 73

The method of example 1 (as well as subject matter of one or more of any combination of examples 2-72), wherein said space frame is configured for use in the interior of a sandwich panel.

Example 74

The method of example 1 (as well as subject matter of one or more of any combination of examples 2-73), wherein said space frame is configured for use in communication with a plate.

Example 75

The method of example 1 (as well as subject matter of one or more of any combination of examples 2-74), wherein said space frame is configured for use in communication with a substrate.

Example 76

The method of example 75 (as well as subject matter of one or more of any combination of examples 2-75), wherein said substrate is a piece of equipment.

Example 77

The method of example 1 (as well as subject matter of one or more of any combination of examples 2-76), wherein at least one said lattice shape member is replaced by a substrate.

Example 78

The method of example 77 (as well as subject matter of one or more of any combination of examples 2-77), wherein said substrate is a plate.

Example 79

The method of example 77 (as well as subject matter of one or more of any combination of examples 2-78), wherein said substrate is a sheet.

Example 80

A space frame device assembled from components. The space frame device may comprise:

a) a plurality of first members comprising alternating linear struts with inflection areas between said alternating linear struts, said first members having an anterior surface and a posterior surface, a recess at each said inflection area of said first members to define an inflection recess, all of said inflection recesses disposed along said anterior surface of said first member;

b) said plurality of said first members in an array with a first portion of said plurality of said first members arrayed substantially parallel to one another, with a second portion of said plurality of said first members arrayed substantially orthogonal to said arrayed first portion of said plurality of said first members, so as to define an intersecting array structure;

said first portion of said plurality of said first members inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure; and c) a lattice shape member comprising struts disposed between nodes, each of said nodes having a mortise recess configured to interface with said tenon or tenon-like structures, said struts configured such that said nodes are aligned such that said mortise recesses are in communication with said tenons or tenon-like structures from the array comprised of said plurality of said first members.

Example 81

The device of example 80, wherein said plurality of first members are produced from a substantially planar material.

Example 82

The device of example 81, wherein said production of said plurality of first members includes cutting.

Example 83

The device of example 81 (as well as subject matter of example 82), wherein said production of said plurality of first members includes machining.

Example 84

The device of example 81 (as well as subject matter of one or more of any combination of examples 81-83), wherein said production of said plurality of first members includes stamping.

Example 85

The device of example 80 (as well as subject matter of one or more of any combination of examples 81-84), wherein at least one of said plurality of first members is molded.

Example 86

The device of example 80 (as well as subject matter of one or more of any combination of examples 81-85), wherein at least one of said plurality of first members is cast.

Example 87

The device of example 80 (as well as subject matter of one or more of any combination of examples 81-86), wherein at least one of said plurality of first members is forged.

Example 88

The device of example 80 (as well as subject matter of one or more of any combination of examples 81-87), wherein at least one of said plurality of first members is produced through sintering.

Example 89

The device of example 80 (as well as subject matter of one or more of any combination of examples 81-88), wherein said lattice shape member is produced from a substantially planar material.

Example 90

The device of example 89 (as well as subject matter of one or more of any combination of examples 81-89), wherein said production of said lattice shape member includes cutting.

Example 91

The device of example 89 (as well as subject matter of one or more of any combination of examples 81-90), wherein said production of said lattice shape member includes machining.

Example 92

The device of example 89 (as well as subject matter of one or more of any combination of examples 81-91), wherein said production of said lattice shape member includes stamping.

Example 93

The device of example 80 (as well as subject matter of one or more of any combination of examples 81-92), wherein said lattice shape member is molded.

Example 94

The device of example 80 (as well as subject matter of one or more of any combination of examples 81-93), wherein said lattice shape member is cast.

Example 95

The device of example 80 (as well as subject matter of one or more of any combination of examples 81-94), wherein said lattice shape member is forged.

Example 96

The device of example 80 (as well as subject matter of one or more of any combination of examples 81-95), wherein said lattice shape member is produced through sintering.

Example 97

The device of example 80 (as well as subject matter of one or more of any combination of examples 81-96), wherein at least a portion of said space frame comprises titanium.

Example 98

The device of example 80 (as well as subject matter of one or more of any combination of examples 81-97), wherein at least a portion of said space frame comprises aluminum.

Example 99

The device of example 80 (as well as subject matter of one or more of any combination of examples 81-98), wherein at least a portion of said space frame comprises steel.

Example 100

The device of example 80 (as well as subject matter of one or more of any combination of examples 81-99), wherein at least a portion of said space frame comprises a metal.

Example 101

The device of example 80 (as well as subject matter of one or more of any combination of examples 81-100), wherein at least a portion of said space frame comprises an alloy.

Example 102

The device of example 80 (as well as subject matter of one or more of any combination of examples 81-101), wherein at least a portion of said space frame comprises stainless steel.

Example 103

The device of example 80 (as well as subject matter of one or more of any combination of examples 81-102), wherein at least a portion of said space frame comprises carbon fiber.

Example 104

The device of example 80 (as well as subject matter of one or more of any combination of examples 81-103), wherein at least a portion of said space frame comprises a ceramic.

Example 105

The device of example 80 (as well as subject matter of one or more of any combination of examples 81-104), wherein at least a portion of said space frame comprises a polymer.

Example 106

The device of example 80 (as well as subject matter of one or more of any combination of examples 81-105), wherein at least a portion of said space frame comprises a cermet.

Example 107

The device of example 80 (as well as subject matter of one or more of any combination of examples 81-106), wherein at least a portion of said space frame comprises a glass.

Example 108

The device of example 80 (as well as subject matter of one or more of any combination of examples 81-107), wherein at least a portion of said space frame comprises a composite material.

Example 109

The device of example 80 (as well as subject matter of one or more of any combination of examples 81-108), wherein said tenon or tenon-like structure comprises a joint.

Example 110

The device of example 80 (as well as subject matter of one or more of any combination of examples 81-109), wherein said tenon or tenon-like structure comprises a halved-joint.

Example 111

The device of example 80 (as well as subject matter of one or more of any combination of examples 81-110), wherein said tenon or tenon-like structure is brazed.

Example 112

The device of example 80 (as well as subject matter of one or more of any combination of examples 81-111), wherein said tenon or tenon-like structure is bonded.

Example 113

The device of example 80 (as well as subject matter of one or more of any combination of examples 81-112), wherein said tenon or tenon-like structure is glued.

Example 114

The device of example 80 (as well as subject matter of one or more of any combination of examples 81-113), wherein said tenon or tenon-like structure is diffusion bonded.

Example 115

The device of example 80 (as well as subject matter of one or more of any combination of examples 81-114), wherein said tenon or tenon-like structure is held together by sintered powder.

Example 116

The device of example 80 (as well as subject matter of one or more of any combination of examples 81-115), wherein said tenon or tenon-like structure is epoxied.

Example 117

The device of example 80 (as well as subject matter of one or more of any combination of examples 81-116), wherein said tenon or tenon-like structure is pinned.

Example 118

The device of example 80 (as well as subject matter of one or more of any combination of examples 81-117), wherein said tenon or tenon-like structure is wedged.

Example 119

The device of example 80 (as well as subject matter of one or more of any combination of examples 81-118), wherein said inflection recesses snap together.

Example 120

The device of example 80 (as well as subject matter of one or more of any combination of examples 81-119), wherein said tenon or tenon like structure comprises a friction fit.

Example 121

The device of example 80 (as well as subject matter of one or more of any combination of examples 81-120), wherein said communication of said inflection recesses comprises an interference fit.

Example 122

The device of example 80 (as well as subject matter of one or more of any combination of examples 81-121), wherein said communication of said mortise recesses and said tenons or tenon-like structures comprises a joint.

Example 123

The device of example 122 (as well as subject matter of one or more of any combination of examples 81-122), wherein said joint is brazed.

Example 124

The device of example 122 (as well as subject matter of one or more of any combination of examples 81-123), wherein said joint is bonded.

Example 125

The device of example 122 (as well as subject matter of one or more of any combination of examples 81-124), wherein said joint is glued.

Example 126

The device of example 122 (as well as subject matter of one or more of any combination of examples 81-125), wherein said joint is diffusion bonded.

Example 127

The device of example 122 (as well as subject matter of one or more of any combination of examples 81-126), wherein said joint is held together by sintered powder.

Example 128

The device of example 122 (as well as subject matter of one or more of any combination of examples 81-127), wherein said joint is epoxied.

Example 129

The device of example 122 (as well as subject matter of one or more of any combination of examples 81-128), wherein said joint is pinned.

Example 130

The device of example 122 (as well as subject matter of one or more of any combination of examples 81-129), wherein said joint is wedged.

Example 131

The device of example 122 (as well as subject matter of one or more of any combination of examples 81-130), wherein said joint snaps together.

Example 132

The device of example 122 (as well as subject matter of one or more of any combination of examples 81-131), wherein said joint comprises a friction fit.

Example 133

The device of example 122 (as well as subject matter of one or more of any combination of examples 81-132), wherein said joint comprises an interference fit.

Example 134

The device of example 80 (as well as subject matter of one or more of any combination of examples 81-133), wherein said space frame comprises a plurality of octet unit cells.

Example 135

The device of example 80 (as well as subject matter of one or more of any combination of examples 81-134), wherein said space frame comprises a plurality of octahedron unit cells.

Example 136

The device of example 80 (as well as subject matter of one or more of any combination of examples 81-135), wherein said space frame comprises a plurality of cubed unit cells.

Example 137

The device of example 80 (as well as subject matter of one or more of any combination of examples 81-136), wherein said space frame comprises a plurality of pyramid unit cells.

Example 138

The device of example 80 (as well as subject matter of one or more of any combination of examples 81-137), wherein said space frame comprises a plurality of tetrahedron unit cells.

Example 139

The device of example 80 (as well as subject matter of one or more of any combination of examples 81-138), wherein said space frame comprises a plurality of diamond unit cells.

Example 140

The device of example 80 (as well as subject matter of one or more of any combination of examples 81-139), wherein said inflection recesses are configured to interface with other said inflection recesses.

Example 141

The device of example 80 (as well as subject matter of one or more of any combination of examples 81-140), wherein at least one of said inflection recesses comprises a slot.

Example 142

The device of example 80 (as well as subject matter of one or more of any combination of examples 81-141), wherein at least one of said inflection recesses comprises a notch.

Example 143

The device of example 80 (as well as subject matter of one or more of any combination of examples 81-142), wherein at least one of said inflection recesses comprises a groove.

Example 144

The device of example 80 (as well as subject matter of one or more of any combination of examples 81-143), wherein at least one of said inflection recesses comprises an aperture.

Example 145

The device of example 80 (as well as subject matter of one or more of any combination of examples 81-144), wherein at least one of said inflection recesses comprises a passage.

Example 146

The device of example 80 (as well as subject matter of one or more of any combination of examples 81-145), wherein at least one of said mortise recesses comprises a slot.

Example 147

The device of example 80 (as well as subject matter of one or more of any combination of examples 81-146), wherein at least one of said mortise recesses comprises a notch.

Example 148

The device of example 80 (as well as subject matter of one or more of any combination of examples 81-147), wherein at least one of said mortise recesses comprises a groove.

Example 149

The device of example 80 (as well as subject matter of one or more of any combination of examples 81-148), wherein at least one of said mortise recesses comprises an aperture.

Example 150

The device of example 80 (as well as subject matter of one or more of any combination of examples 81-149), wherein at least one of said mortise recesses comprises a passage.

Example 151

The device of example 80 (as well as subject matter of one or more of any combination of examples 81-150), wherein at least one of said mortise recesses passes fully through said lattice shape member.

Example 152

The device of example 80 (as well as subject matter of one or more of any combination of examples 81-151), wherein said space frame is configured for use in the interior of a sandwich panel.

Example 153

The device of example 80 (as well as subject matter of one or more of any combination of examples 81-152), wherein said space frame is configured for use in communication with a plate.

Example 154

The device of example 80 (as well as subject matter of one or more of any combination of examples 81-153), wherein said space frame is configured for use in communication with a substrate.

Example 155

The device of example 154 (as well as subject matter of one or more of any combination of examples 81-154), wherein said substrate is a piece of equipment.

Example 156

The device of example 80 (as well as subject matter of one or more of any combination of examples 81-155), wherein at least one said lattice shape member is replaced by a substrate.

Example 157

The device of example 156 (as well as subject matter of one or more of any combination of examples 81-156), wherein said substrate is a plate.

Example 158

The device of example 156 (as well as subject matter of one or more of any combination of examples 81-157), wherein said substrate is a sheet.

Example 159

A method for producing a space frame. The method may comprise:

a) providing a plurality of first members comprising alternating struts with inflection areas between said alternating struts, said first members having an anterior surface and a posterior surface, a recess at each said inflection area of said first members to define an inflection recess, all of said inflection recesses disposed along said anterior surface of said first member;

b) arranging said plurality of said first members into an array with a first portion of said plurality of said first members arrayed substantially parallel to one another, and arranging a second portion of said plurality of said first members arrayed substantially orthogonal to said arrayed first portion of said plurality of said first members, so as to define an intersecting array structure;

wherein said first portion of said plurality of said first members is inverted with respect to said second portion of said plurality of said first members so that said anterior surfaces of said first portion of said plurality of said first members may be in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure;

c) providing an intermediate member comprising mortise recesses configured to interface with said tenon or tenon-like structures, said intermediate member configured such that said mortise recesses are properly spaced so as to communicate with said tenons or tenon-like structures from the array comprised of said plurality of said first members; and d) disposing said intermediate member such that said mortise recess are in communication with said tenons or tenon-like structures to provide a space frame.

Example 160

The method of example 159 (as well as subject matter of one or more of any combination of examples 2-79), wherein said alternating struts comprise one of the following: linear, curved, or a combination of curved and linear.

Example 161

The method of example 159 (as well as subject matter of one or more of any combination of examples 2-79), wherein said intermediate member comprises a substantially planar member or a lattice member.

Example 162

A device having a space frame assembled from components. The space frame may comprise:

a) a plurality of first members comprising alternating struts with inflection areas between said alternating struts, said first members having an anterior surface and a posterior surface, a recess at each said inflection area of said first members to define an inflection recess, all of said inflection recesses disposed along said anterior surface of said first member;

b) said plurality of said first members in an array with a first portion of said plurality of said first members arrayed substantially parallel to one another, with a second portion of said plurality of said first members arrayed substantially orthogonal to said arrayed first portion of said plurality of said first members, so as to define an intersecting array structure;

said first portion of said plurality of said first members inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure; and c) an intermediate member comprising mortise recesses configured to interface with said tenon or tenon-like structures, said intermediate member configured such that said mortise recesses are in communication with said tenons or tenon-like structures from the array comprised of said plurality of said first members.

Example 163

The device of example 162 (as well as subject matter of one or more of any combination of examples 81-158), wherein said alternating struts comprise one of the following: linear, curved, or a combination of curved and linear.

Example 164

The device of example 162 (as well as subject matter of one or more of any combination of examples 81-158), wherein said intermediate member comprises a substantially planar member or a lattice member.

Example 165

The device of examples 80-158 and 162-164, wherein said space frame or truss structure may include any combination of one or more of the following:

a) an architectural structure (for example: pillars, walls, shielding, foundations or floors for tall buildings or pillars, wall shielding floors, for regular buildings and houses), b) a civil engineering field structure (for example: road facilities such as noise resistant walls and crash barriers, road paving materials, permanent and portable aircraft landing runways, pipes, segment materials for tunnels, segment materials for underwater tunnels, tube structural materials, main beams of bridges, bridge floors, girders, cross beams of bridges, girder walls, piers, bridge substructures, towers, dikes and dams, guide ways, railroads, ocean structures such as breakwaters and wharf protection for harbor facilities, floating piers/oil excavation or production platforms, airport structures such as runways), military security/protection/defense structures, c) a machine structure (for example: frame structures for carrying system, carrying pallets, frame structure for robots, etc.), d) an automobile structure (for example: body, frame, doors, chassis, roof and floor, side beams, bumpers, etc.), e) a ship structure (for example: main frame of the ship, body, deck, partition wall, wall, etc.), f) a freight car structure (for example: body, frame, floor, wall, etc.), g) an aircraft structure (for example: wing, main frame, body, floor, etc.), h) a spacecraft structure (for example: body, frame, floor, wall, etc.), i) a space station structure (for example: the main body, floor, wall, etc.), j) a submarine, ship or water craft structure (for example: body, frame, etc.), and k) a blast, ballistic, projectile, shock or impact resistant structure (or any combination thereof).

Example 166

The method of using any of the devices or its components provided in any one or more of examples 80-158 and 162-165.

Example 167

The method of manufacturing any of the devices or its components provided in any one or more of examples 80-158 and 162-165.

REFERENCES

The following patents, applications and publications as listed below and throughout this document are hereby incorporated by reference in their entirety herein. It should be appreciated that various aspects of embodiments of the present method, system, devices, structures, article of manufacture, and compositions may be implemented with the following methods, systems (e.g., systems for using, depositing, and manufacturing), devices, article of manufacture, and compositions disclosed in the following U.S. patent applications, U.S. patents, and PCT International Patent Applications and are hereby incorporated by reference herein and co-owned (vast majority) with the assignee (and which are not admitted to be prior art with respect to the present invention by inclusion in this section):

International Patent Application No. PCT/US2014/033821 entitled "Corrosion Resistant Metal and Metal Alloy Coatings Containing Supersaturated Concentrations of Corrosion Inhibiting Elements and Methods and Systems for Making the Same," filed Apr. 11, 2014.

U.S. patent application Ser. No. 13/640,259 entitled "Multi-Functional Hybrid Panel for Blast and Impact Mitigation and Method of Manufacture," filed Oct. 9, 2012; U.S. Patent Application Publication No. 2013/0263727, Oct. 10, 2013.

International Patent Application No. PCT/US2011/031592 entitled "Multi-Functional Hybrid Panel for Blast and Impact Mitigation and Method of Manufacture," filed Apr. 7, 2011.

U.S. patent application Ser. No. 13/522,264 entitled "Multifunctional Thermal Management System and Related Method," filed Jul. 13, 2012; U.S. Patent Application Publication No. 2013/0014916, Jan. 17, 2013.

International Patent Application No. PCT/US2011/021121 entitled "Multifunctional Thermal Management System and Related Method," filed Jan. 13, 2011.

U.S. patent application Ser. No. 13/448,074 entitled "Manufacture of Lattice Truss Structures from Monolithic Materials," filed Apr. 16, 2012.

U.S. patent application Ser. No. 12/447,166 entitled "Manufacture of Lattice Truss Structures from Monolithic Materials," filed Apr. 24, 2009; U.S. Pat. No. 8,176,635, issued May 15, 2012.

International Patent Application No. PCT/US2007/022733 entitled "Manufacture of Lattice Truss Structures from Monolithic Materials," filed Oct. 26, 2007.

U.S. patent application Ser. No. 13/371,044 entitled "Method and Apparatus Application of Metallic Alloy Coatings," filed Feb. 10, 2012.

U.S. patent application Ser. No. 10/489,090 entitled "Method and Apparatus Application of Metallic Alloy Coatings," filed Mar. 9, 2004; U.S. Pat. No. 8,124,178, issued Feb. 28, 2012.

International Patent Application No. US02/28654 entitled "Method and Apparatus for Application of Metallic Alloy Coatings," filed Sep. 10, 2002.

U.S. patent application Ser. No. 13/337,133 entitled "Reliant Thermal Barrier Coating System and Related Methods and Apparatus of Making the Same," filed Dec. 25, 2011; U.S. Patent Application Publication No. 2012/0160166, Jun. 28, 2012.

U.S. patent application Ser. No. 11/917,585 entitled "Reliant Thermal Barrier Coating System and Related Methods and Apparatus of Making the Same," filed Dec. 14, 2007; U.S. Pat. No. 8,084,086, issued Dec. 27, 2011.

International Patent Application No. US2006/025978 entitled "Reliant Thermal Barrier Coating System and Related Methods and Apparatus of Making the Same," filed Jun. 30, 2006.

U.S. patent application Ser. No. 13/202,828 entitled "Coaxial Hollow Cathode Plasma Assisted Directed Vapor Deposition and Related Method Thereof," filed Aug. 23, 2011; U.S. Patent Application Publication No. 2011/0318498, Dec. 29, 2011.

International Patent Application No. PCT/US2010/025259 entitled "Coaxial Hollow Cathode Plasma Assisted Directed Vapor Deposition and Related Method Thereof," filed Feb. 24, 2010.

U.S. patent application Ser. No. 13/164,189 entitled "Multifunctional Periodic Cellular Solids and the Method of Making the Same," filed Jun. 20, 2011.

U.S. patent application Ser. No. 10/479,833 entitled "Multifunctional Periodic Cellular Solids and the Method of Making the Same," filed Dec. 5, 2003; U.S. Pat. No. 7,963,085, issued Jun. 21, 2011.

International Patent Application No. PCT/US2002/017942 entitled "Multifunctional Periodic Cellular Solids and the Method of Making the Same," filed Jun. 6, 2002.

International Patent Application No. PCT/US2011/035581 entitled "Spotless Arc Directed Vapor Deposition (SA-DVD) and Related Method Thereof," filed May 6, 2011.

U.S. patent application Ser. No. 12/733,160 entitled "Thin Film Battery Synthesis by Directed Vapor Deposition," filed Feb. 16, 2010; U.S. Pat. No. 8,784,512, issued Jul. 22, 2014.

International Patent Application No. PCT/US2008/073071 entitled "Thin Film Battery Synthesis by Directed Vapor Deposition," filed Aug. 13, 2008.

U.S. patent application Ser. No. 12/673,647 entitled "Synergistically-Layered Armor Systems and Methods for Producing Layers Thereof," filed Feb. 16, 2010.

International Patent Application No. PCT/US2008/073377 entitled "Synergistically-Layered Armor Systems and Methods for Producing Layers Thereof," filed Aug. 15, 2008.

U.S. patent application Ser. No. 12/673,418 entitled "Hybrid Periodic Cellular Material Structures, Systems, and Methods for Blast and Ballistic Protection," filed Feb. 12, 2010.

International Patent Application No. PCT/US2008/071848 entitled "Hybrid Periodic Cellular Material Structures, Systems, and Methods for Blast and Ballistic Protection," filed Jul. 31, 2008.

International Patent Application No. PCT/US2009/061888 entitled "Reactive Topologically Controlled Armors for Protection and Related Method," filed Oct. 23, 2009.

U.S. patent application Ser. No. 12/604,654 entitled "Interwoven Sandwich Panel Structures and Related Method Thereof," filed Oct. 23, 2009.

U.S. patent application Ser. No. 12/596,548 entitled "Heat-Managing Composite Structures," filed Oct. 19, 2009; U.S. Patent Application Publication No. 2010/0236759, Sep. 23, 2010.

International Patent Application No. PCT/US2008/060637 entitled "Heat-Managing Composite Structures," filed Apr. 17, 2008.

U.S. patent application Ser. No. 12/301,916 entitled "Method and Apparatus for Jet Blast Deflection," filed Oct. 7, 2009; U.S. Pat. No. 8,360,361, issued Jan. 29, 2013.

International Patent Application No. PCT/US2007/012268 entitled "Method and Apparatus for Jet Blast Deflection," filed May 23, 2007.

U.S. patent application Ser. No. 12/479,408 entitled "Manufacture of Lattice Truss Structures from Monolithic Materials," filed Jun. 5, 2009; U.S. Pat. No. 8,650,756, issued Feb. 18, 2014.

U.S. patent application Ser. No. 12/408,250 entitled "Cellular Lattice Structures With Multiplicity of Cell Sizes and Related Method of Use," filed Mar. 20, 2009.

International Patent Application No. PCT/US2009/034690 entitled "Method for Manufacture of Cellular Structure and Resulting Cellular Structure," filed Feb. 20, 2009.

U.S. patent application Ser. No. 11/928,161 entitled "Method and Apparatus for Heat Exchange Using Hollow Foams and Interconnected Networks and Method of Making the Same," filed Oct. 30, 2007.

U.S. patent application Ser. No. 10/333,004 entitled "Heat Exchange Foam," filed Jan. 14, 2003; U.S. Pat. No. 7,401,643, issued Jul. 22, 2008.

International Patent Application No. PCT/US2001/022266 entitled "Method and Apparatus for Heat Exchange Using Hollow Foams and Interconnected Networks and Method of Making the Same," filed Jul. 16, 2001.

U.S. patent application Ser. No. 11/857,856 entitled "Active Energy Absorbing Cellular Metals and Method of Manufacturing and Using the Same," filed Sep. 19, 2007.

U.S. patent application Ser. No. 10/516,052 entitled "Active Energy Absorbing Cellular Metals and Method of Manufacturing and Using the Same," filed Nov. 29, 2004; U.S. Pat. No. 7,288,326, issued Oct. 30, 2007.

International Patent Application No. US2003/017049 entitled "Active Energy Absorbing Cellular Metals and Method of Manufacturing and Using the Same," filed May 30, 2003.

U.S. patent application Ser. No. 11/788,958 entitled "Multifunctional Battery and Method of Making the Same," filed Apr. 23, 2007; U.S. Patent Application Publication No. 2007/0269716, Nov. 22, 2007.

U.S. patent application Ser. No. 10/110,368 entitled "Multifunctional Battery and Method of Making the Same," filed Apr. 9, 2002; U.S. Pat. No. 7,211,348, issued May 1, 2007.

International Patent Application No. PCT/US2001/025158 entitled "MULTIFUNCTIONAL BATTERY AND METHOD OF MAKING THE SAME," filed Aug. 10, 2001.

U.S. patent application Ser. No. 10/584,682 entitled "Apparatus and Method for Applying Coatings onto the Interior Surfaces of Components and Related Structures Produced Therefrom," filed Jun. 28, 2006; U.S. Pat. No. 8,110,143, issued Feb. 7, 2012.

International Patent Application No. US2005/000606 entitled "Apparatus and Method for Applying Coatings onto the Interior Surfaces of Components and Related Structures Produced Therefrom," filed Jan. 10, 2005.

U.S. patent application Ser. No. 10/566,316 entitled "Method for Application of a Thermal Barrier Coating and Resultant Structure Thereof," filed Jan. 27, 2006.

International Patent Application No. US2004/024232 entitled "Method for Application of a Thermal Barrier Coating and Resultant Structure Thereof," filed Jul. 28, 2004.

U.S. patent application Ser. No. 10/545,042 entitled "Methods for Manufacture of Multilayered Multifunctional Truss Structures and Related Structures Therefrom," filed Aug. 11, 2005.

International Patent Application No. PCT/US2004/004608 entitled "Methods for Manufacture of Multilayered Multifunctional Truss Structures and Related Structures Therefrom," filed Feb. 17, 2004.

U.S. patent application Ser. No. 10/535,364 entitled "Bond Coat for a Thermal Barrier Coating System and Related Method Thereof," filed May 18, 2005.

International Patent Application No. US2003/037485 entitled "Bond Coat for a Thermal Barrier Coating System and Related Method Thereof," filed Nov. 21, 2003.

U.S. patent application Ser. No. 10/533,993 entitled "Extremely Strain Tolerant Thermal Protection Coating and Related Method and Apparatus Thereof," filed May 5, 2005.

International Patent Application No. US2003/036035 entitled "Extremely Strain Tolerant Thermal Protection Coating and Related Method and Apparatus Thereof," filed Nov. 12, 2003.

U.S. patent application Ser. No. 10/526,416 entitled "Blast and Ballistic Protection Systems and Methods of Making Same," filed Mar. 2, 2005; U.S. Pat. No. 7,913,611, issued Mar. 29, 2011.

International Patent Application No. US2003/027605 entitled "Blast and Ballistic Protection Systems and Methods of Making Same," filed Sep. 3, 2003.

U.S. patent application Ser. No. 10/526,296 entitled "Method for Manufacture of Truss Core Sandwich Structures and Related Structures Thereof," filed Mar. 1, 2005; U.S. Pat. No. 7,424,967, issued Sep. 16, 2008.

International Patent Application No. US2003/027606 entitled "Method for Manufacture of Truss Core Sandwich Structures and Related Structures Thereof," filed Sep. 3, 2003.

U.S. patent application Ser. No. 10/522,068 entitled "Method for Manufacture of Cellular Materials and Structures for Blast and Impact Mitigation and Resulting Structure," filed Jan. 21, 2005.

International Patent Application No. PCT/US2003/023043 entitled "Method for Manufacture of Cellular Materials and Structures for Blast and Impact Mitigation and Resulting Structure," filed Jul. 23, 2003.

U.S. patent application Ser. No. 10/522,076 entitled "Method and Apparatus for Dispersion Strengthened Bond Coats for Thermal Barrier Coatings," filed Jan. 21, 2005.

International Patent Application No. US2003/023111 entitled "Method and Apparatus for Dispersion Strengthened Bond Coats for Thermal Barrier Coatings," filed Jul. 24, 2003.

U.S. patent application Ser. No. 10/515,572 entitled "Method for Manufacture of Periodic Cellular Structure and Resulting Periodic Cellular Structure," filed Nov. 23, 2004.

International Patent Application No. PCT/US2003/016844 entitled "Method for Manufacture of Periodic Cellular Structure and Resulting Periodic Cellular Structure," filed May 29, 2003.

U.S. patent application Ser. No. 10/512,161 entitled "Apparatus and Method for Uniform Line of Sight and Non-Line of Sight Coating at High Rate," filed Oct. 15, 2004; U.S. Pat. No. 7,718,222, issued May 18, 2010.

International Patent Application No. US2003/012920 entitled "Apparatus and Method for Uniform Line of Sight and Non-Line of Sight Coating at High Rate," filed Apr. 25, 2003.

U.S. patent application Ser. No. 10/487,291 entitled "Reversible Shape Memory Multifunctional Structural Designs and Method of Using and Making the Same," filed Feb. 20, 2004; U.S. Pat. No. 7,669,799, issued Mar. 2, 2010.

International Patent Application No. US02/27116 entitled "Reversible Shape Memory Multifunctional Structural Designs and Method of Using and Making the Same," filed Aug. 26, 2002.

U.S. patent application Ser. No. 10/476,309 entitled "Method and Apparatus for Efficient Application of Substrate Coating," filed Oct. 29, 2003; U.S. Pat. No. 7,879,411, issued Feb. 1, 2011.

International Patent Application No. PCT/US2002/013639 entitled "Method and Apparatus for Efficient Application of Substrate Coating," filed Apr. 30, 2002.

U.S. patent application Ser. No. 10/296,728 entitled "Multifunctional Periodic Cellular Solids and the Method of Making Thereof," filed Nov. 25, 2002; U.S. Pat. No. 8,247,333, issued Aug. 21, 2012.

International Patent Application No. PCT/US2001/017363 entitled "Multifunctional Periodic Cellular Solids and the Method of Making Thereof," filed May 29, 2001.

U.S. patent application Ser. No. 10/297,347 entitled "Process and Apparatus for Plasma Activated Deposition in a Vacuum," filed Nov. 21, 2002; U.S. Pat. No. 7,014,889, issued Mar. 21, 2006.

International Patent Application No. US01/16693 entitled "A Process and Apparatus for Plasma Activated Deposition In Vacuum," filed May 23, 2001.

U.S. patent application Ser. No. 10/246,018 entitled "Apparatus and Method for Intra-layer Modulation of the Material Deposition and Assist Beam and the Multilayer Structure Produced Therefrom," filed Sep. 18, 2002.

U.S. patent application Ser. No. 09/634,457 entitled "Apparatus and Method for Intra-Layer Modulation of the Material Deposition and Assist Beam and the Multilayer Structure Produced Therefrom," filed Aug. 7, 2000.

International Patent Application No. US99/13450 entitled "Apparatus and Method for Producing Thermal Barrier Coatings," filed Jun. 15, 1999.

International Patent Application No. US97/11185 entitled "Production of Nanometer Particles By Directed Vapor Deposition of Electron Beam Evaporant," filed Jul. 8, 1997.

U.S. patent application Ser. No. 08/679,435 entitled "Production of Nanometer Particles by Directed Vapor Deposition of Electron Beam Evaporant," filed Jul. 8, 1996; U.S. Pat. No. 5,736,073, issued Apr. 7, 1998.

U.S. patent application Ser. No. 08/298,614 entitled "Directed Vapor Deposition of Electron Beam Evaporant," filed Aug. 31, 1994; U.S. Pat. No. 5,534,314, issued Jul. 9, 1996.

U.S. Pat. No. 8,579,018 B1, Roper, et al., "Lightweight Sandwich Panel Heat Pipe", Nov. 12, 2013.

U.S. Patent Application Publication No. US 2011/0117315 A1, Kang, et al., "Truss Type Periodic Cellular Materials Having Internal Cells, Some of Which are Filled with Solid Materials", May 19, 2011.

U.S. Pat. No. 8,745,958 B2, Kang, et al., "3-Dimensional Lattice Truss Structure Composed of Helical Wires and Method for Manufacturing the Same", Jun. 10, 2014.

U.S. Pat. No. 6,170,560 B1, Daily, et al., "Truss Structure Design", Jan. 9, 2001.

U.S. Pat. No. 8,465,825 B1, Cumberland, et al., "Micro-Truss Based Composite Friction-and-Wear Apparatus and Methods of Manufacturing the Same", Jun. 18, 2013.

U.S. Patent Application Publication No. US 2006/0032178 A1, Jensen, D., "Three-Dimensional Grid Panel", Feb. 16, 2006.

U.S. Pat. No. 8,474,764 B2, Kieselstein, et al., "Lightweight Three-Dimensional Wire Structure and Method for the Production Thereof", Jul. 2, 2013.

U.S. Pat. No. 5,070,673, Weisse, D., "Tetrahexagonal Truss Structure", Dec. 10, 1991.

U.S. Pat. No. 6,076,324, Daily, et al., "Truss Structure Design", Jun. 20, 2000.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. A method for producing a space frame, said method comprising:

providing a plurality of first members comprising alternating linear struts with inflection areas between said alternating linear struts, said first members having an anterior surface and a posterior surface, a recess at each said inflection area of said first members to define an inflection recess, all of said inflection recesses disposed along said anterior surface of said first member;

arranging said plurality of said first members into an array with a first portion of said plurality of said first members arrayed substantially parallel to one another; and arranging a second portion of said plurality of said first members arrayed substantially orthogonal to said arrayed first portion of said plurality of said first members, so as to define an intersecting array structure;

wherein said first portion of said plurality of said first members is inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure;

providing a lattice shape member comprising struts disposed between nodes, each of said nodes having a mortise recess configured to interface with said tenon or tenon-like structures, said struts configured such that said nodes are located such that said mortise recesses are properly spaced so as to communicate with said tenons or tenon-like structures from the array comprised of said plurality of said first members; and disposing said lattice shape member such that said mortise recess of said nodes are in communication with said tenons or tenon-like structures to provide said space frame.

2. The method of claim 1, wherein said providing a plurality of first members comprises:

producing said plurality of first members from a substantially planar material.

3. The method of claim 2, wherein said producing includes cutting.

4. The method of claim 2, wherein said producing includes machining.

5. The method of claim 2, wherein said producing includes stamping.

6. The method of claim 1, wherein said providing a plurality of first members comprises molding said plurality of first members.

7. The method of claim 1, wherein said providing a plurality of first members comprises casting said plurality of first members.

8. The method of claim 1, wherein said providing a plurality of first members comprises forging said plurality of first members.

9. The method of claim 1, wherein said providing a plurality of first members comprises sintering said plurality of first members.

10. The method of claim 1, wherein said providing a lattice shape member comprises:

producing said lattice shape member from a substantially planar material.

11. The method of claim 10, wherein said producing includes cutting.

12. The method of claim 10, wherein said producing includes machining.

13. The method of claim 10, wherein said producing includes stamping.

14. The method of claim 1, wherein said providing a lattice shape member comprises molding said lattice shape member.

15. The method of claim 1, wherein said providing a lattice shape member comprises casting said lattice shape member.

16. The method of claim 1, wherein said providing a lattice shape member comprises forging said lattice shape member.

17. The method of claim 1, wherein said providing a lattice shape member comprises sintering said lattice shape member.

18. The method of claim 1, wherein at least a portion of said space frame comprises titanium.

19. The method of claim 1, wherein at least a portion of said space frame comprises aluminum.

20. The method of claim 1, wherein at least a portion of said space frame comprises steel.

21. The method of claim 1, wherein at least a portion of said space frame comprises a metal.

22. The method of claim 1, wherein at least a portion of said space frame comprises an alloy.

23. The method of claim 1, wherein at least a portion of said space frame comprises stainless steel.

24. The method of claim 1, wherein at least a portion of said space frame comprises carbon fiber.

25. The method of claim 1, wherein at least a portion of said space frame comprises a ceramic.

26. The method of claim 1, wherein at least a portion of said space frame comprises a polymer.

27. The method of claim 1, wherein at least a portion of said space frame comprises a cermet.

28. The method of claim 1, wherein at least a portion of said space frame comprises a glass.

29. The method of claim 1, wherein at least a portion of said space frame comprises a composite material.

30. The method of claim 1, wherein said tenon or tenon-like structure provides an interface that comprises a joint.

31. The method of claim 1, wherein said tenon or tenon-like structure provides an interface that comprises a halved-joint.

32. The method of claim 1, wherein said tenon or tenon-like structure provides an interface that is brazed.

33. The method of claim 1, wherein said tenon or tenon-like structure provides an interface that is bonded.

34. The method of claim 1, wherein said tenon or tenon-like structure provides an interface that is glued.

35. The method of claim 1, wherein said tenon or tenon-like structure provides an interface that is diffusion bonded.

36. The method of claim 1, wherein said tenon or tenon-like structure provides an interface that is held together by sintered powder.

37. The method of claim 1, wherein said tenon or tenon-like structure provides an interface that is epoxied.

38. The method of claim 1, wherein said tenon or tenon-like structure provides an interface that is pinned.

39. The method of claim 1, wherein said tenon or tenon-like structure provides an interface that is wedged.

40. The method of claim 1, wherein said inflection recesses snap together to form said tenon or tenon-like structure.

41. The method of claim 1, wherein a friction fit of said inflection recesses form said tenon or tenon-like structure.

42. The method of claim 1, wherein an interference fit of said inflection recesses form said tenon or tenon-like structure.

43. The method of claim 1, wherein said communication of said mortise recess and said tenons or tenon-like structures comprises a joint.

44. The method of claim 43, wherein said joint is brazed.

45. The method of claim 43, wherein said joint is bonded.

46. The method of claim 43, wherein said joint is glued.

47. The method of claim 43, wherein said joint is diffusion bonded.

48. The method of claim 43, wherein said joint is held together by sintered powder.

49. The method of claim 43, wherein said joint is epoxied.

50. The method of claim 43, wherein said joint is pinned.

51. The method of claim 43, wherein said joint is wedged.

52. The method of claim 43, wherein said joint snaps together.

53. The method of claim 43, wherein said joint comprises a friction fit.

54. The method of claim 43, wherein said joint comprises an interference fit.

55. The method of claim 1, wherein said space frame comprises a plurality of octet unit cells.

56. The method of claim 1, wherein said space frame comprises a plurality of octahedron unit cells.

57. The method of claim 1, wherein said space frame comprises a plurality of cubed unit cells.

58. The method of claim 1, wherein said space frame comprises a plurality of pyramid unit cells.

59. The method of claim 1, wherein said space frame comprises a plurality of tetrahedron unit cells.

60. The method of claim 1, wherein said space frame comprises a plurality of diamond unit cells.

61. The method of claim 1, wherein said inflection recesses are configured to interface with other said inflection recesses.

62. The method of claim 1, wherein at least one of said inflection recesses of comprises a slot.

63. The method of claim 1, wherein at least one of said inflection recesses comprises a notch.

64. The method of claim 1, wherein at least one of said inflection recesses comprises a groove.

65. The method of claim 1, wherein at least one of said inflection recesses comprises an aperture.

66. The method of claim 1, wherein at least one of said inflection recesses comprises a passage.

67. The method of claim 1, wherein at least one of said mortise recesses comprises a slot.

68. The method of claim 1, wherein at least one of said mortise recesses comprises a notch.

69. The method of claim 1, wherein at least one of said mortise recesses comprises a groove.

70. The method of claim 1, wherein at least one of said mortise recesses comprises an aperture.

71. The method of claim 1, wherein at least one of said mortise recesses comprises a passage.

72. The method of claim 1, wherein at least one of said mortise recesses passes fully through said lattice shape member.

73. The method of claim 1, wherein said space frame is configured for use in a sandwich panel.

74. The method of claim 1, wherein said space frame is configured for use in communication with a plate.

75. The method of claim 1, wherein said space frame is configured for use in communication with a substrate.

76. The method of claim 75, wherein said substrate is a piece of equipment.

77. The method of claim 1, wherein at least one said lattice shape member is replaced by a substrate.

78. The method of claim 77, wherein said substrate is a plate.

79. The method of claim 77, wherein said substrate is a sheet.

80. A space frame device assembled from components, wherein said space frame device comprising:

a plurality of first members comprising alternating linear struts with inflection areas between said alternating linear struts, said first members having an anterior surface and a posterior surface, a recess at each said inflection area of said first members to define an inflection recess, all of said inflection recesses disposed along said anterior surface of said first member;

said plurality of said first members in an array with a first portion of said plurality of said first members arrayed substantially parallel to one another, with a second portion of said plurality of said first members arrayed substantially orthogonal to said arrayed first portion of said plurality of said first members, so as to define an intersecting array structure;

said first portion of said plurality of said first members inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure; and a lattice shape member comprising struts disposed between nodes, each of said nodes having a mortise recess configured to interface with said tenon or tenon-like structures, said struts configured such that said nodes are aligned such that said mortise recesses are in communication with said tenons or tenon-like structures from the array comprised of said plurality of said first members.

81. The device of claim 80, wherein said plurality of first members are produced from a substantially planar material.

82. The device of claim 81, wherein said production of said plurality of first members includes cutting.

83. The device of claim 81, wherein said production of said plurality of first members includes machining.

84. The device of claim 81, wherein said production of said plurality of first members includes stamping.

85. The device of claim 80, wherein at least one of said plurality of first members is molded.

86. The device of claim 80, wherein at least one of said plurality of first members is cast.

87. The device of claim 80, wherein at least one of said plurality of first members is forged.

88. The device of claim 80, wherein at least one of said plurality of first members is produced through sintering.

89. The device of claim 80, wherein said lattice shape member is produced from a substantially planar material.

90. The device of claim 89, wherein said production of said lattice shape member includes cutting.

91. The device of claim 89, wherein said production of said lattice shape member includes machining.

92. The device of claim 89, wherein said production of said lattice shape member includes stamping.

93. The device of claim 80, wherein said lattice shape member is molded.

94. The device of claim 80, wherein said lattice shape member is cast.

95. The device of claim 80, wherein said lattice shape member is forged.

96. The device of claim 80, wherein said lattice shape member is produced through sintering.

97. The device of claim 80, wherein at least a portion of said space frame comprises titanium.

98. The device of claim 80, wherein at least a portion of said space frame comprises aluminum.

99. The device of claim 80, wherein at least a portion of said space frame comprises steel.

100. The device of claim 80, wherein at least a portion of said space frame comprises a metal.

101. The device of claim 80, wherein at least a portion of said space frame comprises an alloy.

102. The device of claim 80, wherein at least a portion of said space frame comprises stainless steel.

103. The device of claim 80, wherein at least a portion of said space frame comprises carbon fiber.

104. The device of claim 80, wherein at least a portion of said space frame comprises a ceramic.

105. The device of claim 80, wherein at least a portion of said space frame comprises a polymer.

106. The device of claim 80, wherein at least a portion of said space frame comprises a cermet.

107. The device of claim 80, wherein at least a portion of said space frame comprises a glass.

108. The device of claim 80, wherein at least a portion of said space frame comprises a composite material.

109. The device of claim 80, wherein said tenon or tenon-like structure comprises a joint.

110. The device of claim 80, wherein said tenon or tenon-like structure comprises a halved-joint.

111. The device of claim 80, wherein said tenon or tenon-like structure is brazed.

112. The device of claim 80, wherein said tenon or tenon-like structure is bonded.

113. The device of claim 80, wherein said tenon or tenon-like structure is glued.

114. The device of claim 80, wherein said tenon or tenon-like structure is diffusion bonded.

115. The device of claim 80, wherein said tenon or tenon-like structure is held together by sintered powder.

116. The device of claim 80, wherein said tenon or tenon-like structure is epoxied.

117. The device of claim 80, wherein said tenon or tenon-like structure is pinned.

118. The device of claim 80, wherein said tenon or tenon-like structure is wedged.

119. The device of claim 80, wherein said inflection recesses snap together.

120. The device of claim 80, wherein said tenon or tenon like structure comprises a friction fit.

121. The device of claim 80, wherein said communication of said inflection recesses comprises an interference fit.

122. The device of claim 80, wherein said communication of said mortise recesses and said tenons or tenon-like structures comprises a joint.

123. The device of claim 122, wherein said joint is brazed.

124. The device of claim 122, wherein said joint is bonded.

125. The device of claim 122, wherein said joint is glued.

126. The device of claim 122, wherein said joint is diffusion bonded.

127. The device of claim 122, wherein said joint is held together by sintered powder.

128. The device of claim 122, wherein said joint is epoxied.

129. The device of claim 122, wherein said joint is pinned.

130. The device of claim 122, wherein said joint is wedged.

131. The device of claim 122, wherein said joint snaps together.

132. The device of claim 122, wherein said joint comprises a friction fit.

133. The device of claim 122, wherein said joint comprises an interference fit.

134. The device of claim 80, wherein said space frame comprises a plurality of octet unit cells.

135. The device of claim 80, wherein said space frame comprises a plurality of octahedron unit cells.

136. The device of claim 80, wherein said space frame comprises a plurality of cubed unit cells.

137. The device of claim 80, wherein said space frame comprises a plurality of pyramid unit cells.

138. The device of claim 80, wherein said space frame comprises a plurality of tetrahedron unit cells.

139. The device of claim 80, wherein said space frame comprises a plurality of diamond unit cells.

140. The device of claim 80, wherein said inflection recesses are configured to interface with other said inflection recesses.

141. The device of claim 80, wherein at least one of said inflection recesses comprises a slot.

142. The device of claim 80, wherein at least one of said inflection recesses comprises a notch.

143. The device of claim 80, wherein at least one of said inflection recesses comprises a groove.

144. The device of claim 80, wherein at least one of said inflection recesses comprises an aperture.

145. The device of claim 80, wherein at least one of said inflection recesses comprises a passage.

146. The device of claim 80, wherein at least one of said mortise recesses comprises a slot.

147. The device of claim 80, wherein at least one of said mortise recesses comprises a notch.

148. The device of claim 80, wherein at least one of said mortise recesses comprises a groove.

149. The device of claim 80, wherein at least one of said mortise recesses comprises an aperture.

150. The device of claim 80, wherein at least one of said mortise recesses comprises a passage.

151. The device of claim 80, wherein at least one of said mortise recesses passes fully through said lattice shape member.

152. The device of claim 80, wherein said space frame is configured for use in a sandwich panel.

153. The device of claim 80, wherein said space frame is configured for use in communication with a plate.

154. The device of claim 80, wherein said space frame is configured for use in communication with a substrate.

155. The device of claim 154, wherein said substrate is a piece of equipment.

156. The device of claim 80, wherein at least one said lattice shape member is replaced by a substrate.

157. The device of claim 156, wherein said substrate is a plate.

158. The device of claim 156, wherein said substrate is a sheet.

159. A method for producing a space frame, said method comprising:

providing a plurality of first members comprising alternating struts with inflection areas between said alternating struts, said first members having an anterior surface and a posterior surface, a recess at each said inflection area of said first members to define an inflection recess, all of said inflection recesses disposed along said anterior surface of said first member;

arranging said plurality of said first members into an array with a first portion of said plurality of said first members arrayed substantially parallel to one another, and arranging a second portion of said plurality of said first members arrayed substantially orthogonal to said arrayed first portion of said plurality of said first members, so as to define an intersecting array structure;

wherein said first portion of said plurality of said first members is inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure;

providing an intermediate member comprising mortise recesses configured to interface with said tenon or tenon-like structures, said intermediate member configured such that said mortise recesses are properly spaced so as to communicate with said tenons or tenon-like structures from the array comprised of said plurality of said first members; and disposing said intermediate member such that said mortise recess are in communication with said tenons or tenon-like structures to provide said space frame.

160. The method of claim 159, wherein said alternating struts comprise one of the following:

linear, curved, or a combination of curved and linear.

161. The method of claim 159, wherein said intermediate member comprises a substantially planar member or a lattice member.

162. A device having a space frame assembled from components, wherein said space frame comprising:

a plurality of first members comprising alternating struts with inflection areas between said alternating struts, said first members having an anterior surface and a posterior surface, a recess at each said inflection area of said first members to define an inflection recess, all of said inflection recesses disposed along said anterior surface of said first member;

said plurality of said first members in an array with a first portion of said plurality of said first members arrayed substantially parallel to one another, with a second portion of said plurality of said first members arrayed substantially orthogonal to said arrayed first portion of said plurality of said first members, so as to define an intersecting array structure;

said first portion of said plurality of said first members inverted with respect to said second portion of said plurality of said first members so that said anterior surfaces of said first portion of said plurality of said first members are in communication with said anterior surfaces of said second portion of said plurality of said first members;

said first portion of said plurality of said first members and said second portion of said plurality of said first members aligned so that said inflection recesses of said inflection areas of said first portion of said plurality of said first members are in communication with said inflection recesses of said inflection areas of said second portion of said plurality of said first members to define a tenon or tenon-like structure; and an intermediate member comprising mortise recesses configured to interface with said tenon or tenon-like structures, said intermediate member configured such that said mortise recesses are in communication with said tenons or tenon-like structures from the array comprised of said plurality of said first members.

163. The device of claim 162, wherein said alternating struts comprise one of the following:

linear, curved, or a combination of curved and linear.

164. The device of claim 162, wherein said intermediate member comprises a substantially planar member or a lattice member.

* * * * *